United States Patent [19]

Hara

[11] 4,354,334

[45] Oct. 19, 1982

BEST AVAILABLE COPY

[54] APPARATUS FOR ATTACHMENT OF SHEET CARRIERS TO CONTAINERS

[75] Inventor: Kunio Hara, Kawasaki, Japan

[73] Assignee: Nifco Inc., Tokyo, Japan

[21] Appl. No.: 171,680

[22] Filed: Jul. 24, 1980

[51] Int. Cl.[3] ..... B65B 27/04

[52] U.S. Cl. ..... 53/48; 53/556; 53/585

[58] Field of Search ..... 53/48, 585, 441, 582, 53/591, 556, 295, 291

[56] References Cited

U.S. PATENT DOCUMENTS

| | | | |
|---|---|---|---|
| 2,340,211 | 1/1944 | Balsley et al. | 53/291 |
| 2,846,835 | 8/1958 | Aguilar et al. | 53/291 |
| 2,936,558 | 5/1960 | Glazer | 53/48 X |
| 3,404,505 | 10/1968 | Hohl et al. | 53/48 X |
| 3,541,751 | 11/1970 | Quebe et al. | 53/48 X |
| 3,551,258 | 12/1971 | Owen et al. | 53/441 X |
| 4,016,704 | 4/1977 | Fujio | 53/292 X |
| 4,144,631 | 3/1979 | Fujio | 53/556 X |
| 4,177,546 | 12/1979 | Geisinger | 53/585 X |
| 4,208,857 | 6/1980 | Fujio | 53/585 |

*Primary Examiner*—Horace M. Culver
*Attorney, Agent, or Firm*—Thomas W. Buckman

[57] ABSTRACT

In an apparatus for expanding a sheet carrier and fitting it onto containers which comprises a funnel member possessing a radially contractable leading end, a sleeve member for accommodating the aforementioned funnel member, a radially contracting member interposed between the aforementioned funnel member and sleeve member and an axial member disposed within the funnel member and possessing a expanded leading portion, the open end of the funnel member is radially contracted by the forward movement of the contracting member and admitted, in conjunction with the expanded portion of the axial member, into the opening of the sheet carrier and, thereafter, the open end of the funnel member is allowed to resume its original shape. Then, by fitting the peripheral edge of a container into the open end of the funnel member and moving the funnel member backwardly relative to the sleeve member, the opening of the carrier fitted round the outer surface of the funnel member is pushed up the outer surface of the funnel member by the open end of the sleeve member and, as a result, radially expanded in proportion as the outside diameter of the funnel member is increased. Eventually, the opening is caused to ride over the open end of the funnel member and wrap itself round the outer surface below the peripheral edge of the container.

4 Claims, 29 Drawing Figures

APPARATUS FOR ATTACHMENT OF SHEET CARRIERS TO CONTAINERS

BACKGROUND OF THE INVENTION

This invention relates to an apparatus for the attachment of plastic container carriers to the peripheral edges of a plurality of containers such as for soft drinks, which carriers are of sheet form and adapted to bind the plurality of containers together for convenience in carrying.

Among the carrier devices adapted to bind the peripheral edges of a plurality of containers standing side by side on their flat ends for the purpose of convenience in carrying, there is included a plastic container sheet carrier. The sheet carrier has a plurality of openings each surrounded by an annular portion. In the remaining intervening spaces of the sheet carrier, there are provided two grip holes adapted for insertion of the fingers.

In an ordinary container such as a can for a soft drink, both or at least one of the opposite ends of the container has its end surface slightly bent inwardly except for the peripheral edge which circumferentially surrounds the end. The circumferential edge has a diameter slightly greater than the diameter of the main portion of the container which lies underneath. In most cases, these containers are made of aluminum.

The openings in the sheet carrier have a diameter smaller than the diameter of the main portion of the container. This carrier, therefore, is attached to the containers by forcibly expanding the annular portions of the openings to enlarge the openings and allow the peripheral edges of the containers to slide past the annular portions, then allowing the annular portions to resume their original shape thereby causing the inner surfaces of the annular portions to come into tight contact with the outer surfaces of the main portions of the containers. After the sheet carrier has been attached as described above, the user has only to insert his thumb and index finger into the grip holes and take hold of the remaining portion of the sheet carrier. In this manner, he can carry the containers conveniently without requiring a holder as would otherwise be required in carrying the plurality of containers.

As described above, the sheet carrier of such a construction proves to be highly useful. One problem which has been encountered by the conventional sheet carrier concerns the procedure involved when the openings are forcibly expanded out in effecting the attachment of the carrier to the containers. This forcible outward expansion of the openings, when made with the finger tips on all the containers, requires a considerable amount of force, though it is not impossible. From the standpoint of operational efficiency and in consideration of the large number of openings involved, such a manual procedure proves substantially impracticable.

To cope with the situation, therefore, there has been suggested a device capable of mechanically effecting this work (U.S. Pat. No. 3,628,305). This device is adapted so that two pins are inserted inside a pair of opposed openings and the pair of openings are expanded outwardly. This device, consequently, has the disadvantage that the annular portions tend to be torn, expanded unevenly, and brought into contact with the outer surfaces of the containers with insufficient tightness. Besides, this device entails a serious problem that when the pins are removed after the ends of the containers have been inserted into the expanded openings, the pins, which must be of great rigidity, tend to scratch the containers, possibly to the extend of impairing their commercial value.

The inventor, therefore, proposed a method and apparatus capable of enabling a sheet carrier to be efficiently attached to containers without the possibility of causing breakage in the sheet carrier and inflicting scratches upon the lateral surfaces of the containers (U.S. patent application Ser. No. 104,926).

SUMMARY OF THE INVENTION

One object of this invention is to provide an apparatus for efficient attachment of a sheet carrier to containers with a view to improving the formerly proposed apparatus for the attachment of separate sheet carriers to containers.

Another object of this invention is to provide an apparatus for easily attaching sheet carriers having elliptical or circular openings to a plurality of containers.

To accomplish the objects described above according to the present invention, there is provided an apparatus for the attachment of sheet carriers to containers which comprises a plurality of funnel members provided with a first tapered portion and a second tapered portion, a sleeve member for accommodating the funnel member, a contracting member disposed concentrically between the funnel member and the sleeve member, an axial member disposed inside the funnel member and provided at the leading end thereof with an enlarged portion, drive means adapted to move the members mentioned above relatively to one another, means for feeding a container to the open end of the funnel member having the outer surface thereof fitted in an opening in the sheet carrier, and means capable of removing from the funnel member the container attached to the carrier and subsequently feeding the sheet carrier to the open end of the funnel member.

The second tapered portion of the aforementioned funnel member is contracted by the forward motion of the contracting member, the open end of the funnel member is inserted in conjunction with the enlarged portion of the axial member into the opening of the sheet carrier, then by the retraction of the contracting member and the axial member, the open end of the funnel member is returned to its original shape and, at the same time, the enlarged portion of the axial member is fitted into the open end to prevent the funnel member from being bent inwardly, the container is supplied into the open end of the funnel member and subsequently the funnel member and the axial member are further moved backwardly with the sheet carrier fitted around the outer surface of the funnel member being prevented from moving backwardly by the sleeve member, the carrier, because of its elasticity, is radially enlarged gradually with entry of the funnel member therein and eventually caused to ride over the open end of the funnel member and wrap itself around the peripheral surface of the container.

Owing to the grouping of the simple components described above, the apparatus of the present invention permits the sheet carrier to be easily attached to the container without scratching the outer surface of the container. By having these components operated in fixed sequence and timing, the overall operation of the apparatus of the present invention can readily be automated.

The other objects and characteristics of the present invention will become apparent from the description to be given hereinafter in detail with reference to the accompanying drawing.

DESCRIPTION OF PREFERRED EMBODIMENT

Figure 1:
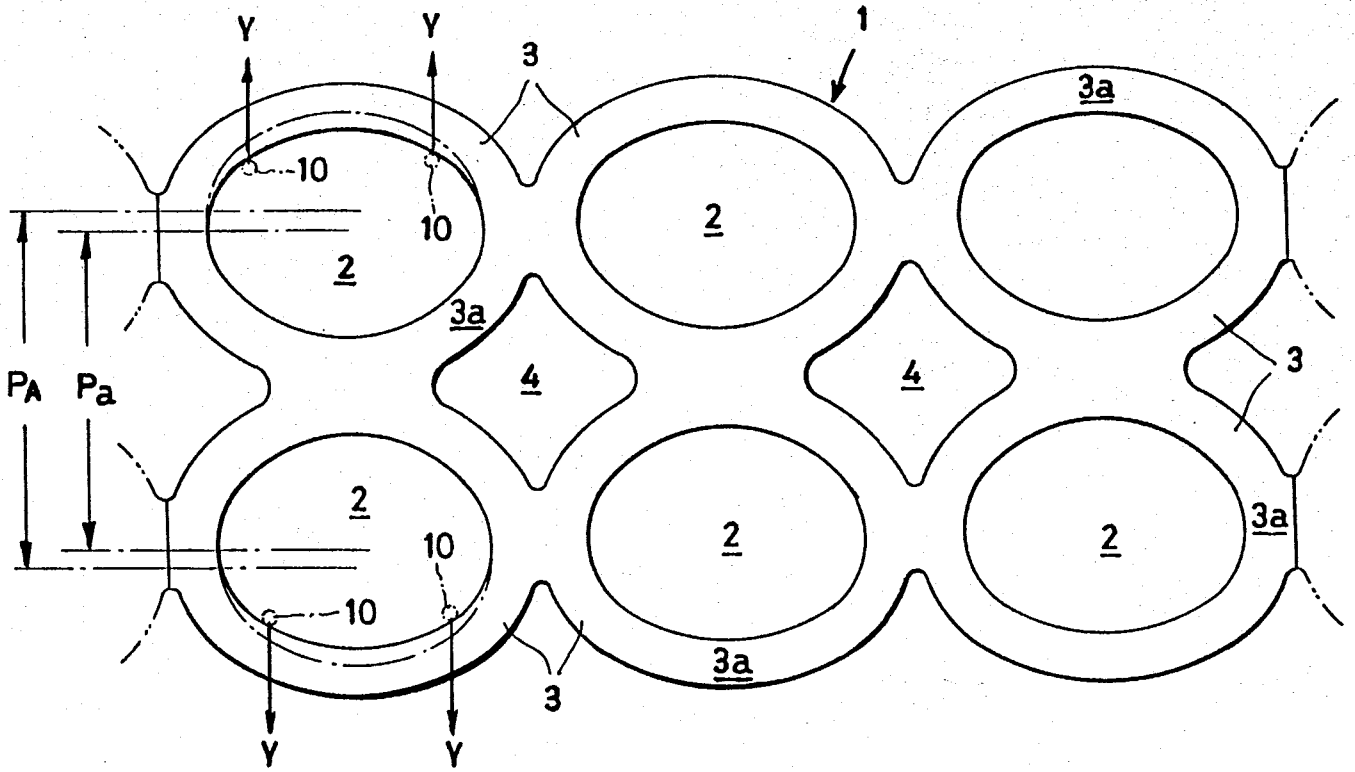
FIG. 1 is a plan view of one embodiment of a container sheet carrier to be attached to a given set of containers by the apparatus of this invention.
Figure 2:
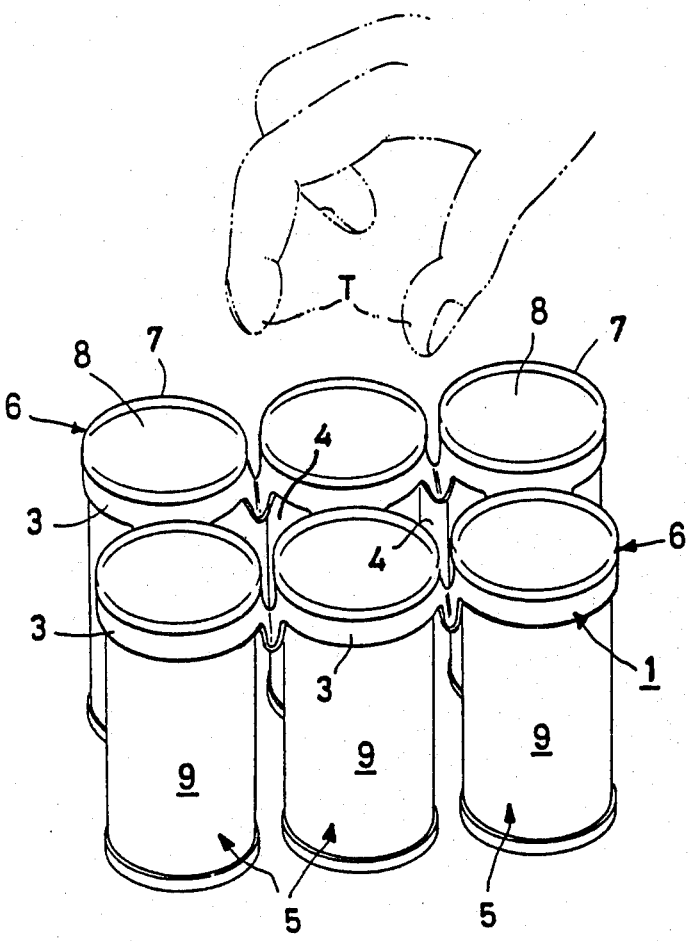
FIG. 2 is an explanatory diagram illustrating the state wherein a given set of containers are held by the carrier.

FIG. 1 illustrates an example of a known container carrier made of stretchable or elastic plastic flat sheet material, and FIG. 2 illustrates the condition in which six containers are bound for convenience in carrying by using the aforementioned carrier.

Figure 3:
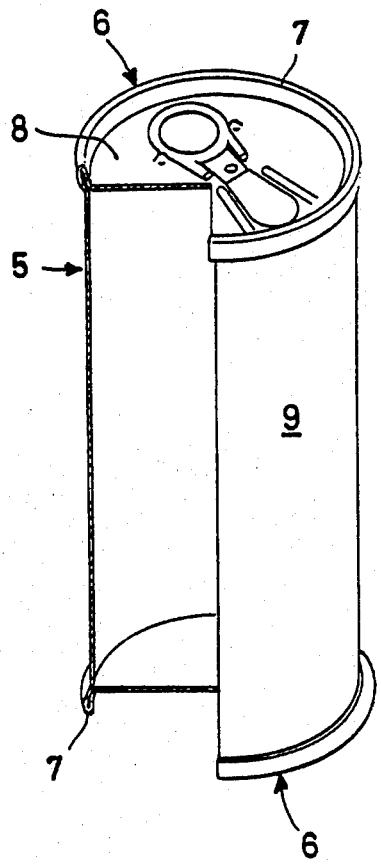
FIG. 3 is a partially cutaway perspective view of a container to which the carrier is attached.

In an ordinary container such as a can for a soft drink, as shown in FIG. 3, both or at least one of the opposite ends 6 has its end surface 8 set slightly inwardly from a peripheral edge 7 which surrounds the end. The peripheral edge 7 has a diameter slightly greater than the diameter of the main portion 9 of the container which lies underneath. In most cases, these containers are made of aluminum.

Openings 2 in the sheet carrier 1 have a diameter smaller than that of the main portion 9 of the containers and, naturally, smaller than the diameter of the peripheral edge 7 which is greater than the diameter of the main portion. This sheet carrier 1, therefore, is attached to the containers 5 as illustrated in FIG. 2 by forcibly expanding the annular portions 3 of the openings to enlarge the openings 2 and allow the peripheral edges 7 to slide past the annular portions, then allowing the annular portions to resume their original shape thereby causing the inner surfaces 3*a* of the annular portions 3 to come into tight contact with the outer surfaces of the main portions 9 of the containers. After the sheet carrier 1 has been attached as described above, the user has only to insert his thumb and index finger into the grip holes 4 and take hold of the remaining portion of the carrier. In this manner, he can carry the containers conveniently without requiring a holder as would otherwise be required in carrying the plurality of containers.

As described above, the sheet carrier of such a construction proves to be highly useful. One problem which has been encountered by the conventional sheet carrier concerns the procedure involved when the openings 2 are forcibly expanded out in effecting the attachment of the carrier to the containers. This forcibly outward expansion of the openings, when made with the finger tips on all the containers, requires a considerable amount of force, though it is not impossible. From the standpoint of operational efficiency and in consideration of the large number of openings involved, such a manual procedure proves substantially impracticable.

To cope with the situation, therefore, there has been suggested a device capable of mechanically effecting this work. This device is adapted so that a pair of pins 10 are inserted inside each opening 2 as indicated by chain lines in only two of the openings 2 of FIG. 1 and the pair of openings 2 are expanded outwardly by moving the pins 10 outwardly as indicated by the arrows "Y". As readily noted from the arrangement just described, each pin 10 exerts its expanding force at only one point on the annular portion 3. This device, consequently, has the disadvantage that the annular portions tend to be torn, expanded unevenly, and brought into contact with the outer surfaces of the containers with insufficient tightness. Besides, this device entails a serious problem that when the pins are removed after the ends of the containers have been inserted into the expanded openings, the pins, which must be of great rigidity, tend to scratch the containers, possibly to the extent of impairing their commercial value. Generally the pins 10 are adapted so as to be driven straight outwardly in a common parallel plane. When about six containers are simultaneously packaged as illustrated, therefore, the device incorporating these pins inevitably occupies a fairly large space and tends to be impaired in the flexibility of its operation.

Moreover, as concerns the shape of the openings 2 for insertion of the containers, the mere fact that the openings 2 have a diameter smaller than the diameter of the peripheral edges 7 of the containers or preferably even smaller than the diameter of the main portions 9 of the containers, does not necessarily mean that the openings fulfill their function satisfactorily. In view of the directions in which the pins 10 are made to operate, the shape of the openings has unfortunately been limited to that of an ellipse having its minor axis in the distance of movement of the pins. Since the annular portions 3 of the openings are made of a plastic material possessed of both deformability and adaptability of shape, they need not by nature be limited in shape. Further from the standpoint of the simplicity of the tool used for making such openings in the carrier, the openings are naturally desired to be shaped as circles. Also from this point of view, the device falls short of satisfactoriness.

Figure 4:
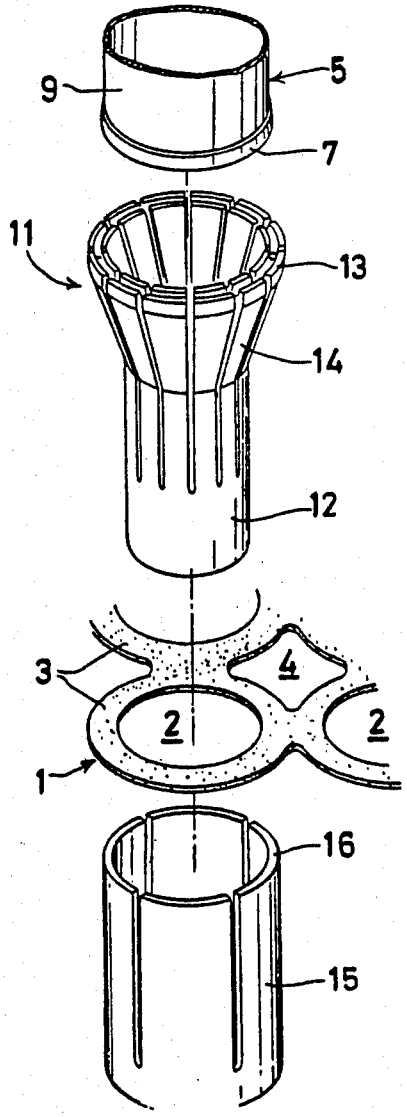
FIG. 4 is an exploded perspective view of the principal components of the apparatus for sheet carrier attachment proposed formerly by the inventor.

In view of the state of affairs described above, the inventor proposed an apparatus for effecting attachment of a sheet carrier to containers with the aid of a funnel member 11 having the leading end thereof diverged in the shape of a funnel and a sleeve member 15 possessing an open end 16 adapted to be fitted around the cylindrical portion of the aforementioned funnel member 11 as illustrated in FIG. 4. This funnel member 11 is formed of the cylindrical portion 12 and funnel portion 14 which originates halfway of the height of the cylindrical portion 12 and gradually diverges. The outside diameter of the cylindrical portion 12 is smaller than the diameter of the openings 2 formed in the sheet carrier 1, while the outside diameter at the leading end 13 of the funnel portion 14 is greater than the diameter of the openings 2 in the carrier 1 and is substantially equal to the outside diameter of the peripheral edge 7 of the container 5. In the funnel portion 14 and parts of the cylindrical portion 12, a plurality of slits are cut in the longitudinal direction to impart resiliency to the funnel portion.

The sleeve member 15 is in a columnar or cylindrical shape and has an inside diameter substantially equal to the diameter of the openings 2 in the sheet carrier 1, so that when one opening 2 in the carrier 1 is placed in correspondence with the open end 16 of the sleeve member 15, the open end of the sleeve member collides with the annular portion 3 surrounding the opening 2 of the carrier. In order to acquire resiliency, the sleeve member is also provided with a plurality of longitudinally slits. The funnel member 11 and the sleeve member 15 are produced by the injection molding of a plastic material.

Attachment of the sheet carrier 1 to a container 5 is effected by first having the peripheral edge 7 at the lower end of the container 5 received in the leading end 13 of the funnel member 11 and, at the same time, fitting the opening of the sheet carrier 1 around the cylindrical portion 12 of the funnel member, then inserting the sleeve member 15 around the cylindrical portion 12 and pushing it up the cylindrical portion, whereby the carrier 1 is slid smoothly up the cylindrical portion 12 and then is forcibly spread out gradually as the carrier begins and continues to slide up the funnel portion 14. The open end 16 of the sleeve member, by virtue of the slits longitudinally inserted therein, is similarly expanded outwardly in conformity with the peripheral shape of the funnel portion and consequently caused to push up the annular portion 3 surrounding the opening of the carrier, with the final result that the carrier rides over the leading end of the funnel portion and brings its opening 2 into fast engagement with the main portion 9 of the container.

The foregoing describes the aforementioned apparatus as used on just one container. When funnel members 11 and sleeve members 15 are positioned one each exactly below the openings in a sheet carrier, as many containers as the openings in the sheet carrier can be attached by the same procedure all at once to the sheet carrier.

The present invention aims to improve further the aforementioned apparatus so as to enable a plurality of containers to be substantially automatically attached to the sheet carrier. It is described below with reference to the accompanying drawing.

In the operation of the first embodiment illustrated in FIGS. 5–20, the operations of transferring a sheet carrier, mounting containers in prescribed positions and removing the sets of containers after they are attached to the carriers are manually performed.

The apparatus 21 of this embodiment possesses a working plane 23 maintained by suitable supporting means 22 such as legs at a height convenient for the operation of the apparatus. Along one longitudinal edge of the working plane 23, a sheet carrier strip holding roller 24 on which a strip containing a long series of carriers 1 is wound up is held in position by suitable supporting frames 25 and a rotary shaft 26 in a manner such that the carrier strip will be paid off the roll. In the present embodiment, the carrier strip is produced by serially repeating the molding of the unit two-row carrier pattern of FIG. 1 in the direction of the rows by a known method, and the carrier strip thus produced is wound up on the roller 24. The free end of the portion of the carrier strip unwound from the roll is led onto the working plane 23 and caught by carrier transfer means 27.

Figure 7:
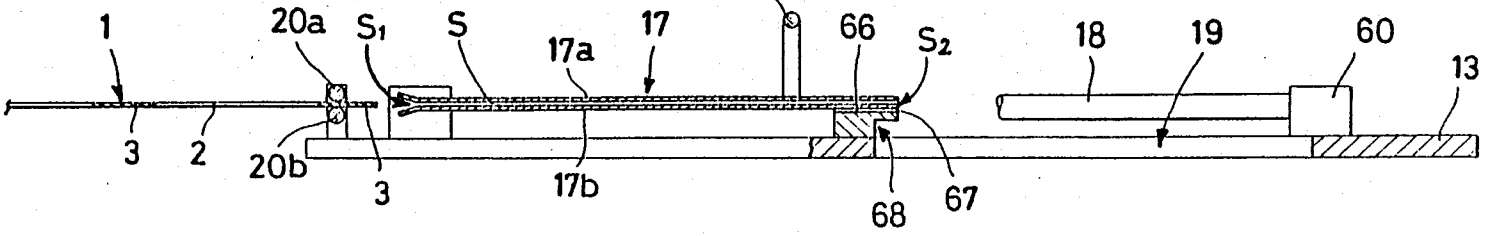
FIG. 7 is a partially sectioned side view of the apparatus of FIG. 5.
Figure 8:
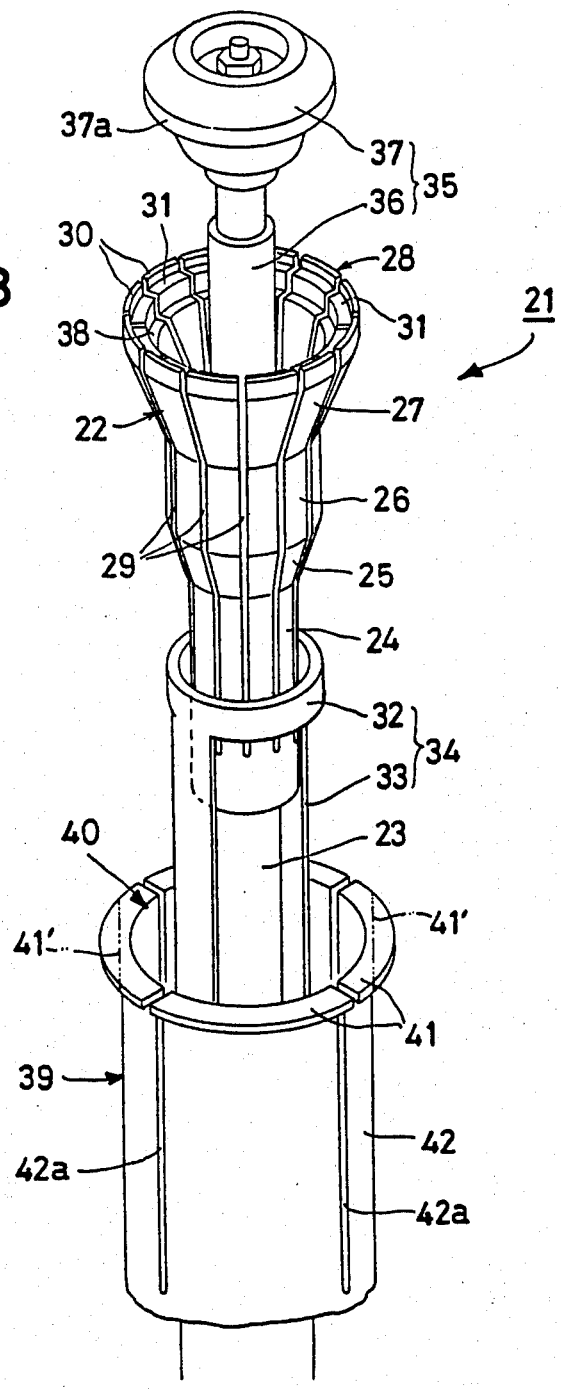
FIG. 8 is an exploded perspective view of the carrier expanding and fitting means in the apparatus of FIG. 5.

The carrier transfer means 27 in the present embodiment is formed of two plates 27*a*, 27*b* which are opposed to each other across a gap "S" roughly equal to the thickness of the carrier and are retained in this relative position with their lateral sides secured to each other by suitable means (FIG. 7). The loose end of the unwound portion of the carrier strip is inserted through the inlet open end $S_1$ of the gap "S" and pulled slightly out of the outlet open end $S_2$. Since the carrier 1 is kept gently squeezed between the opposed plates 27*a*, 27*b*, the friction generated on the carrier strip by the opposed plates enables the carrier strip to be moved simultaneously with the motion of the carrier transfer means 27.

The carrier transfer means 27 is provided on the lateral sides thereof with cylindrical retaining means 27' to be slidable on a pair of guide bars 28 disposed along the lateral sides of the plates 27*a*, 27*b* in order that the carrier transfer means 27 may be manually moved above the working plane between a first position closer to the carrier roller and a second position farther from the carrier roller. The working plane 23 contains an open portion 29 therein at the portion corresponding to the second position of the carrier transfer means 27. Below this open portion 29 are disposed carrier spreading and fitting means 31 which will be described more fully later. (The lower construction is omitted from FIGS. 6–7).

Since, in the present embodiment, a unit operation is regarded as consisting in the attachment of six containers to six carrier openings 2 formed in three files and two rows in the carrier, the two plates 27*a*, 27*b* of the carrier transfer means 27 have sufficient length to completely embrace one carrier unit including three files each of two openings. The stroke of the carrier transfer means, namely the distance to be covered by the movement of the carrier transfer means from the first to the second position thereof, similarly equals the distance required for the movement of a single carrier unit. Further, the two plates which serve to retain the carrier gently therein are provided with two oblong openings 27*c* so as to catch hold of the opposite lateral ends and the central portion of the carrier and expose the openings 2 and their respective annular portions. In the present embodiment, therefore, the plates 27*a*, 27*b* both possess a shape resembling the letter "E". To ensure convenience in introducing the loose end of the carrier 1 into the carrier transfer means, rollers 30 adapted to nip the carrier 1 in the vertical direction are disposed at the inner open end $S_1$ of the gap "S" formed between the two plates 27*a*, 27*b*.

Below the open portion 29 in the working plane 23 there are positioned six carrier expanding and fitting means 31 upwardly opposed to the openings 2 formed in three files and two rows in the carrier nipped by the carrier transfer means 27 which has been brought to the second position over the open portion. The basic components of one representative carrier expanding and fitting means 31, except for the drive source, are illustrated in a disassembled manner in FIG. 8.

The first component is a funnel member 32 having the leading open end thereof diverged in the shape of a funnel. The funnel member 32 is wholly made of a synthetic resin and is composed of a shaft portion 33 adapted to be connected to a drive mechanism which will be described more fully later, a cylindrical portion 34, a first tapered portion 35 having its diameter gradually increased upwardly, an interconnecting portion 36 extending upwardly with a uniform diameter from the upper end of the first tapered portion 35, and a second tapered portion 37 having its diameter gradually increased again in the upward direction. The interior of the funnel member 32 is hollow at least from the first tapered portion through the second tapered portion. A plurality of slits 39 are inserted at suitable circumferential intervals downwardly from the leading end 38 at least to half the height of the first tapered portion, and generally to the lower part of the lower cylindrical portion 34 is in the present illustrated embodiment. The section of the funnel member 32 from the first tapered portion to the second tapered portion is flexible in the radial direction. Because of the elasticity possessed by the material of which the funnel member is made, the funnel member possesses force of restitution.

Concerning the relation among the diameters of the component parts of the funnel member, the diameter of the interconnecting portion 36, which is equal to the largest diameter of the first tapered portion 35 and the smallest diameter of the second tapered portion 37, is such that the interconnecting portion 36 smoothly fits into the opening 2 in the carrier 1.

The diameter at the leading end 38 of the funnel member 32 is desired to be equal to or slightly greater than the diameter of the peripheral edge 7 of the container 5 to which the carrier is to be attached. To stabilize its motion, the leading end 38 is provided with an inner wall surface 40 adapted to be wrapped around the peripheral edge 7 and a stepped surface 41 adapted to collide in the axial direction with the peripheral edge 7, so that the peripheral edge of the container is snugly received in the leading end 38 of the funnel member.

A member 44 for radially contracting the funnel member which comprises a ring portion 42 placed concentrically outwardly relative to the funnel member 32 and a suitable number of leg portions 43 extended downwardly from the lower end of the ring portion is disposed in a telescopically slidable manner on the funnel member 32. The diameter of the ring portion 42 is at least smaller than the largest diameter of the first tapered portion 35.

The contracting member 44, intended to fulfill a function to be described later, is interlocked with an axial member 45 which penetrates through the hollow interior of the funnel member 32. The lower section of the shank 46 of this contracting member penetrates through the interior of the lower shaft portion 33 of the funnel member, while the leading end thereof forms a generally drum-shaped portion 47. This portion 47 serves to prevent the leading end 38 of the funnel member from being inwardly bent or from being deformed unexpectedly. The outermost edge portion of the drum-shaped portion 47, therefore, is adapted to be brought into contact with the stepped surface 48 which is formed below the stepped surface 41 of the funnel member for admitting the peripheral edge of the container. The leading end of the drum-shaped portion 47 which protrudes from the outermost edge portion has a height such that it barely touches or does not touch the peripheral edge of the container. This relationship will be described more fully later.

These two mutually interlocking members 44, 45 may be made of steel. In the illustrated embodiment, the contracting member 44 is made of a plastic material and the axial member of a metallic material.

Another important member is the hollow sleeve member 49 which is concentrically disposed relative to the aforementioned two members 44, 45. This sleeve member is desired to be made of a synthetic resin. It has the general shape of a cylinder containing a hollow interior for accommodating the aforementioned three members 32, 44 and 45. The inside diameter of the opening 50 of the sleeve member 49 is roughly equal to the smallest diameter and at least smaller than the largest diameter of the second tapered portion 37 of the funnel member. The peripheral edge 51 of the opening 50 in the sleeve member 49 is expected, as described more fully later, to give an even upward push to the carrier which has been fitted freely around the funnel member. For this reason, this peripheral edge 51 is formed in the shape of a flange so as to come into stable contact with the carrier. In this sleeve member, a plurality of slits 52 of a suitable length are inserted at suitable circumferential intervals in the axial direction, so that the peripheral edge at the leading end thereof possesses a force of restitution which permits the edge to be expanded outwardly in the radial direction and contracted inwardly to its original state.

Figure 5:
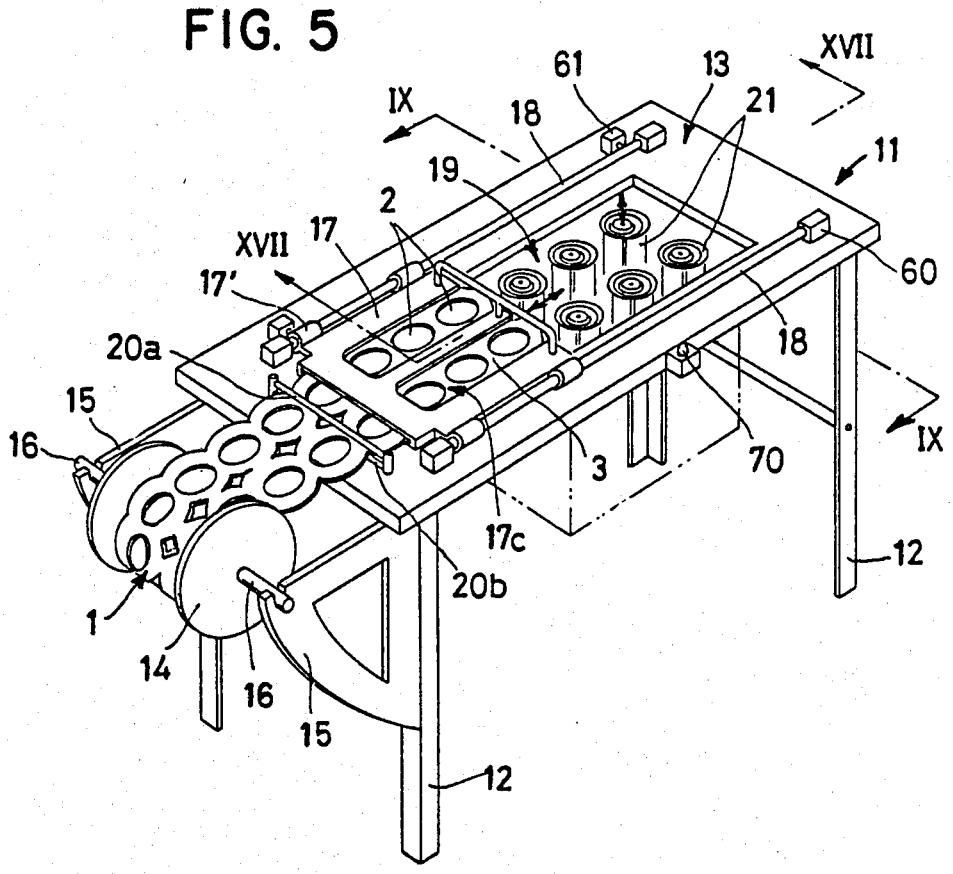
FIG. 5 is a schematic perspective view of the first embodiment of an apparatus for the attachment of a sheet carrier to containers according to the present invention.
Figure 6:
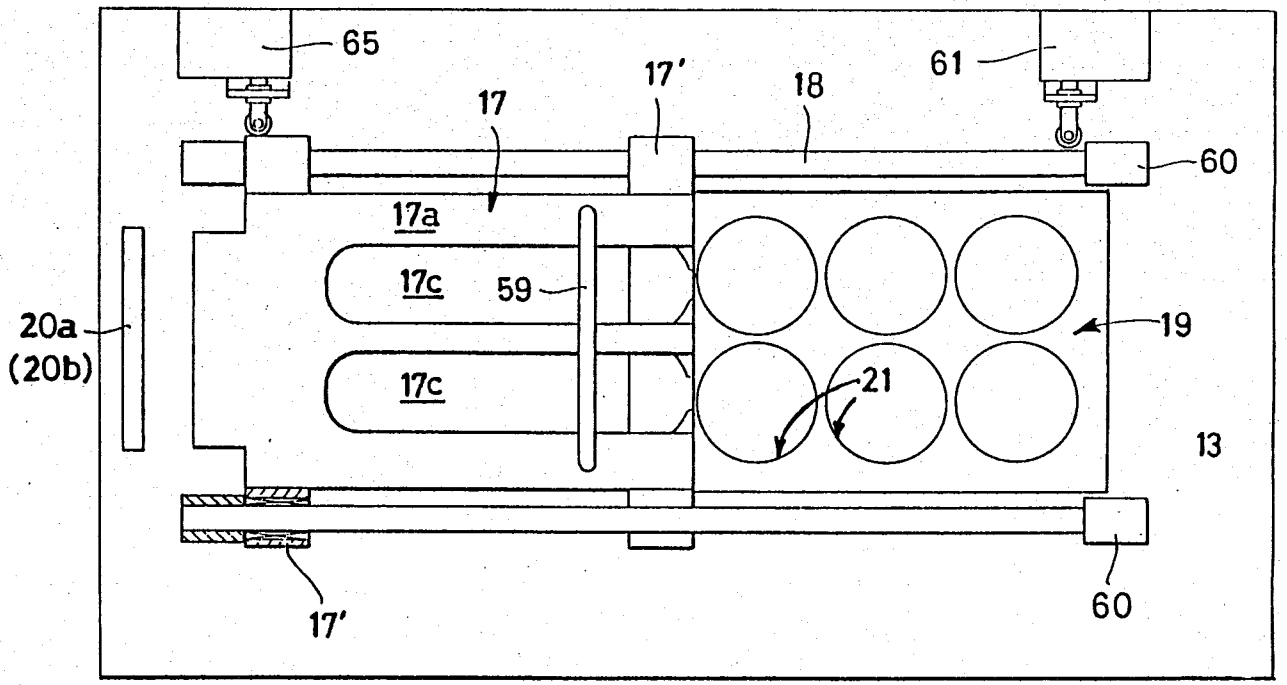
FIG. 6 is a schematic plan view of the apparatus of FIG. 5.
Figure 9:
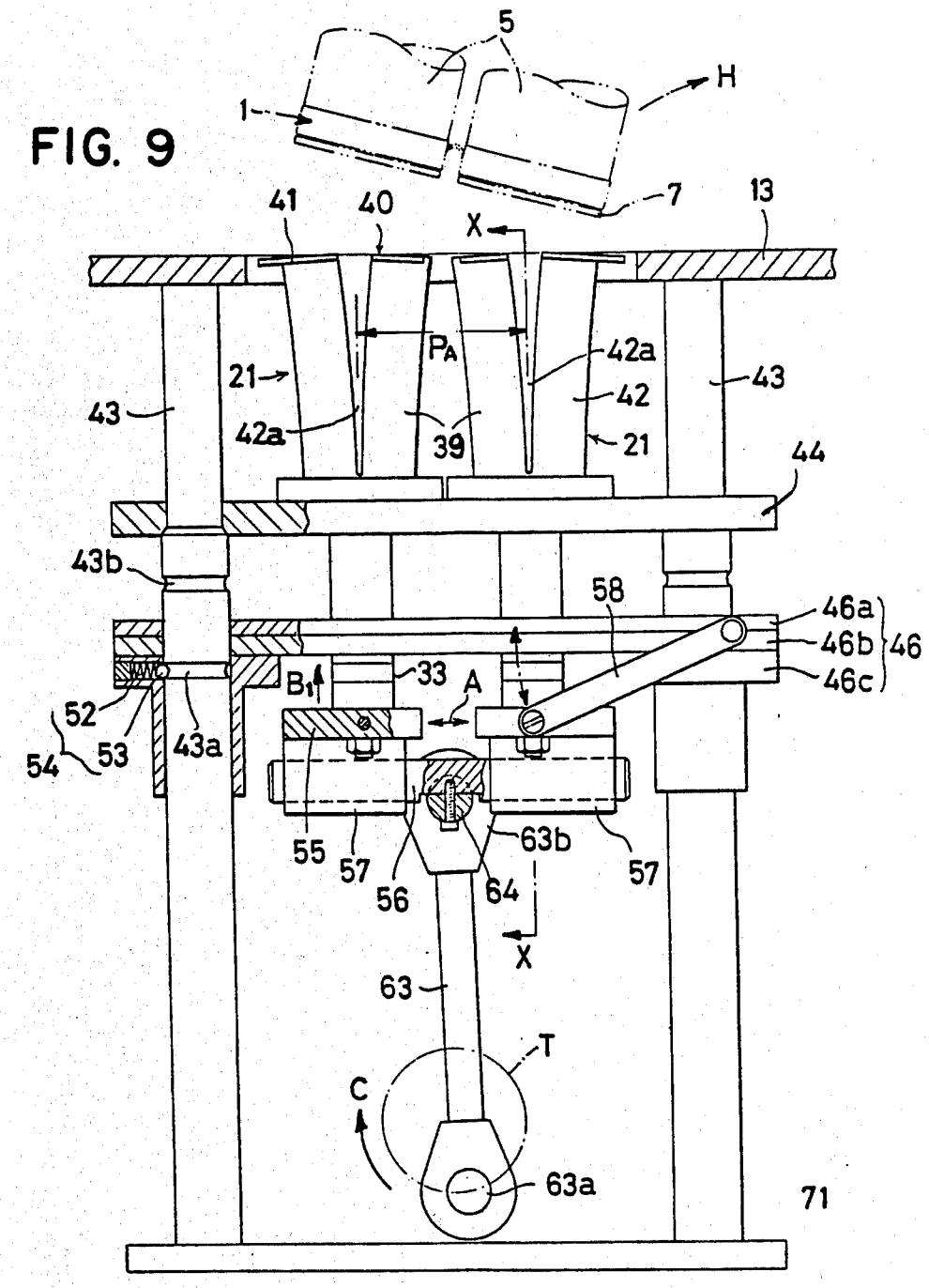
FIG. 9 is a partially sectioned front view taken along the line IX—IX in FIG. 5 as held in a state assumed after the attachment of the sheet carrier to the containers is completed.
Figure 17:
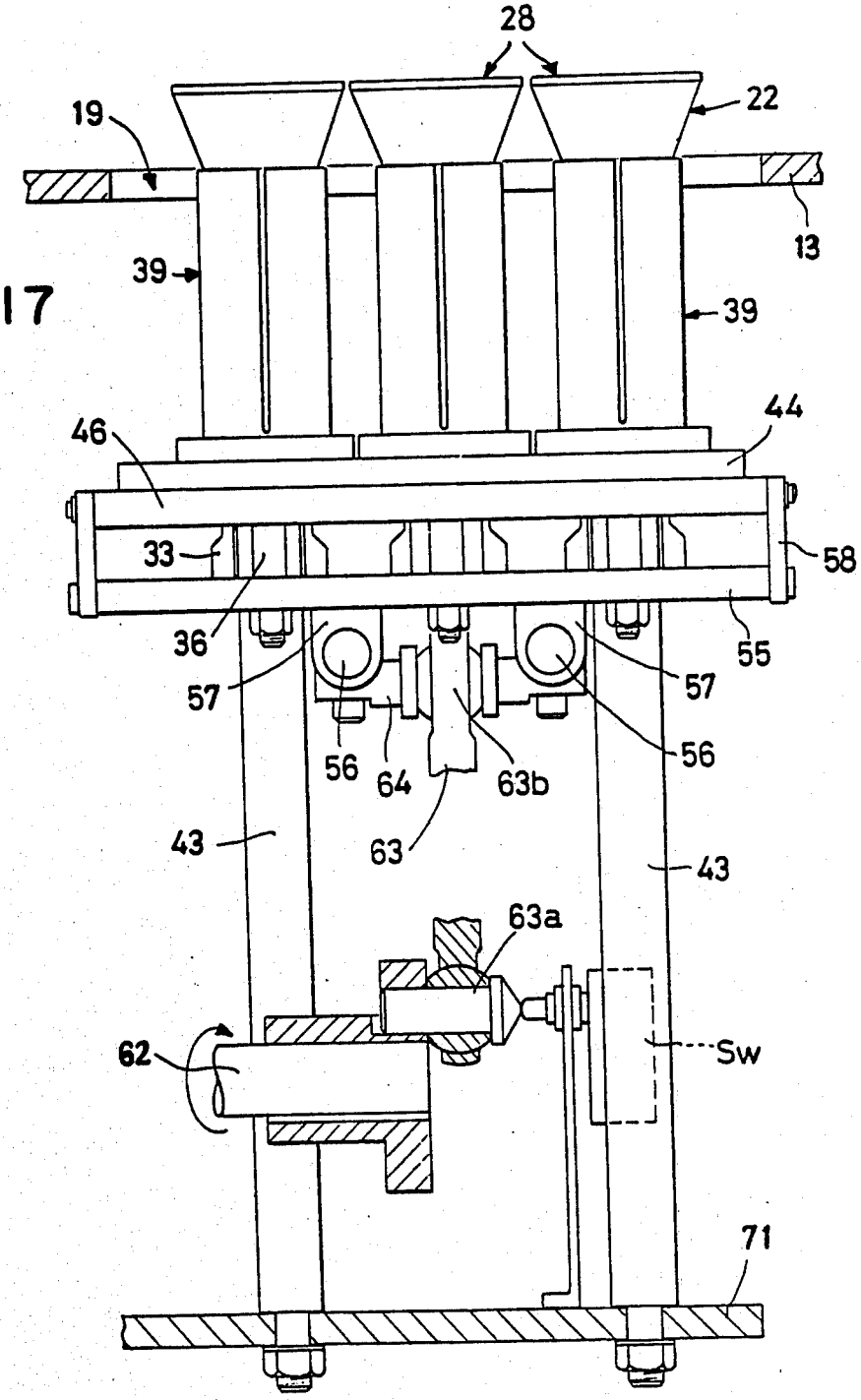
FIG. 17 is a partially sectioned side view of the apparatus of FIG. 5 as held in the condition of FIG. 15.

The carrier expanding and fitting means 31 is formed of the four members 32, 44, 45 and 49 as described above. A total of six such means 31 are arranged at close intervals in two rows below the opening 29 of the working plane 23. FIG. 9 illustrates the condition in which two such means are set in position in the direction of files (the direction in which count is taken of the number of rows) in the cross section taken along the line IX—IX of FIG. 5 and FIG. 17 illustrates the condition in which three such means 31 are set in position in the direction of rows (the direction in which count is taken of the number of files). The relationship of the positioning of these members will become self-evident from the further description of the operation of the apparatus to be made below with reference to FIGS. 9–10.

Figure 10:
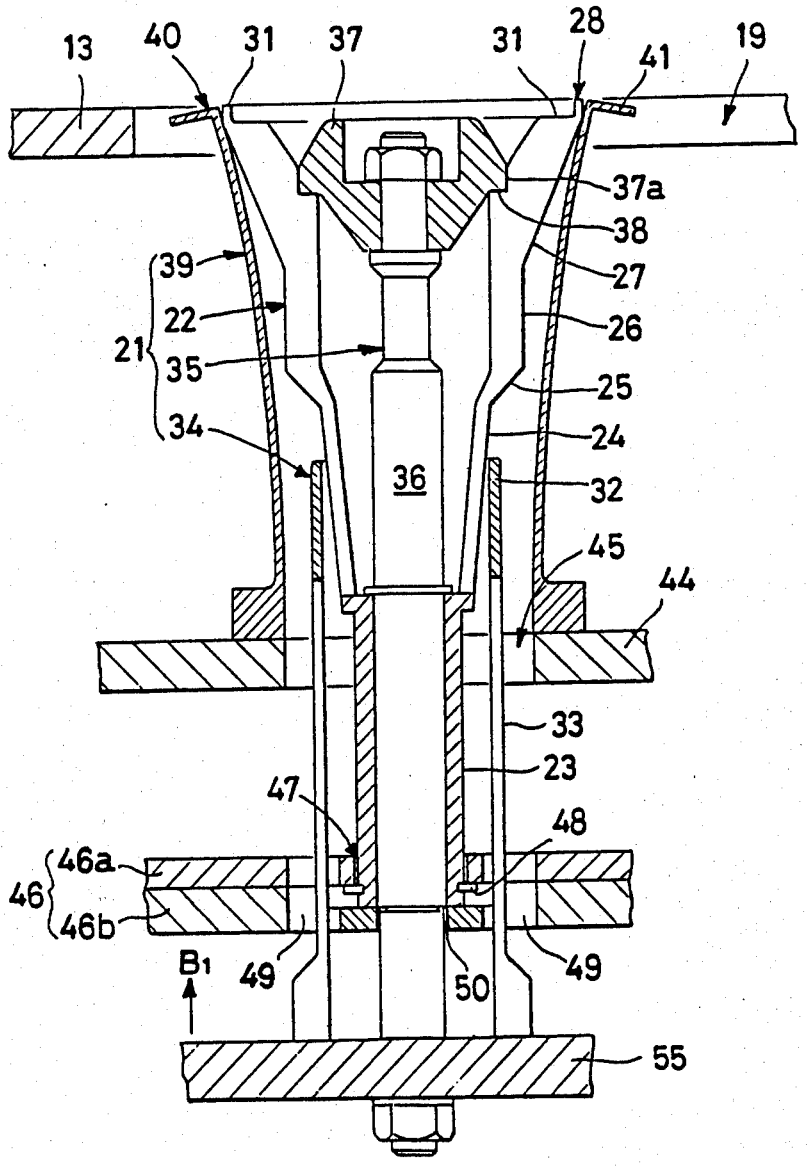
FIG. 10 is a sectioned view taken along the line X—X in FIG. 9.

FIGS. 9–10 illustrate the state which the apparatus of this invention assume after it has completed attachment of the carrier 1 to the containers 5 and has subsequently released the containers 5 as bound by the attached carrier 1. Now, the operation of the apparatus will be described below, with the aforementioned state as the starting point.

The aforementioned four members, namely the sleeve member 49, the contracting member 44, the funnel member 32 and the axial member 45 have their respective ends opposite from those directed toward the container fastened to the plate members 54, 65, 56 and 65. These plate members are attached, some stationarily and others vertically movably, to support columns 53 which extend downwardly from the lower side of the working plane 23.

Specifically, the sleeve member 49 which is situated at the outermost part of the relevant carrier expanding and fitting means 31 is stationary relative to the supporting columns 53 and is fixed by a known fastening means such as setscrews to the first sleeve supporting plate 54 which assumes the nearest position, the uppermost position in this case, to the container, so that the opening 50 of the sleeve member 49 will be flush with or slightly lower than the working plane 23. Actually in this case, a total of six sleeve members 49 opposed to the openings 2 formed in two rows and three files in the carrier are fixed at stated intervals to one sleeve supporting plate 54.

Figure 14:
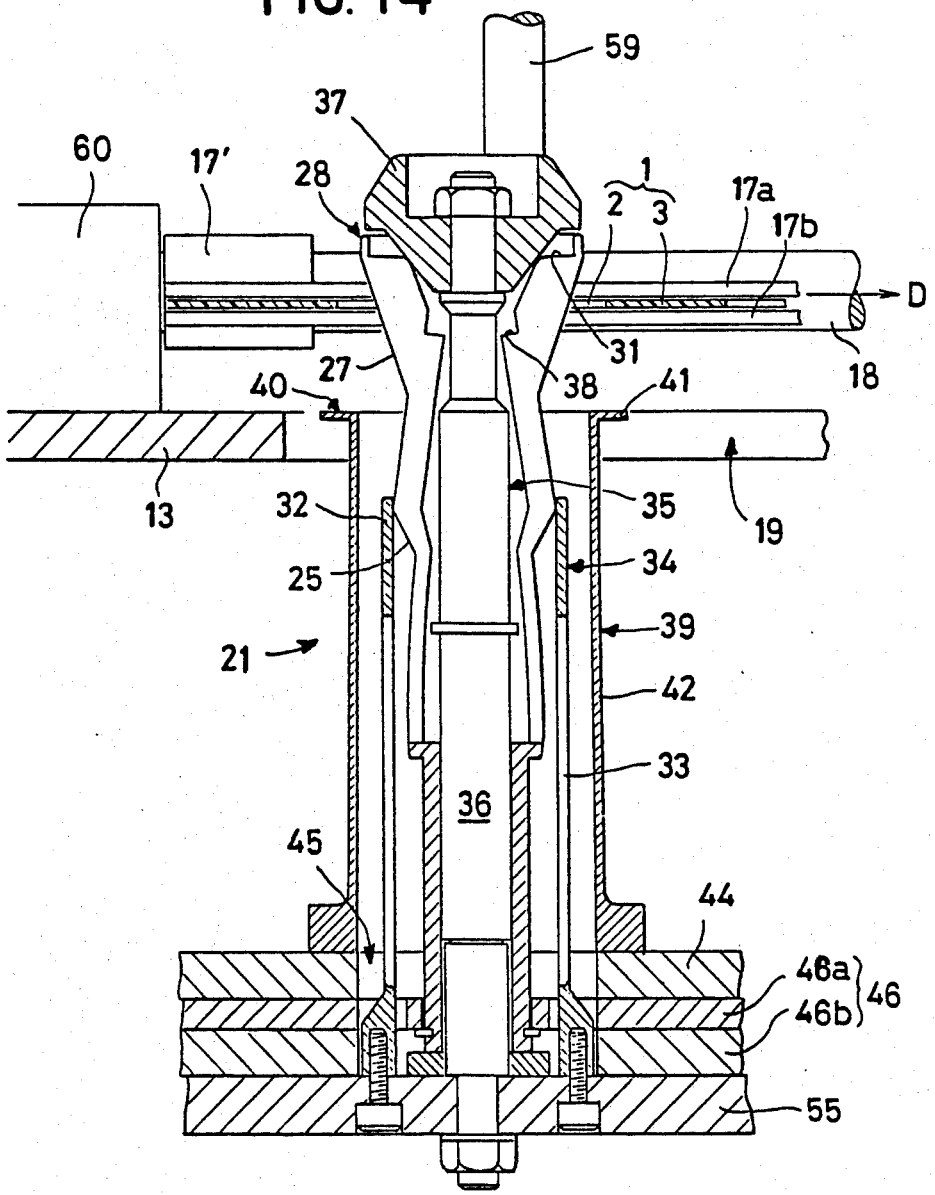
FIG. 14 is a sectioned view of the apparatus of FIG. 5 as taken along the line X—X of FIG. 9, showing the leading ends of the axial member and the funnel member as inserted into the opening of the sheet carrier.

The lower end of the funnel member 32 passes through the opening 55 formed in the sleeve supporting plate 54 having a diameter approximating the inside diameter of the sleeve member and is fastened to the funnel member supporting plate 56. This second supporting plate 56 is set in position so as to be freely slidable along the supporting columns 53 between the first position in FIG. 10 and the second position at which it collides with the sleeve supporting plate 54 (FIG. 14). While the funnel member 32 is stationary in the axial direction relative to the supporting plate 56, it is allowed to move laterally to some extent in the direction as indicated by the arrow "A" in FIG. 9.

Figure 11:
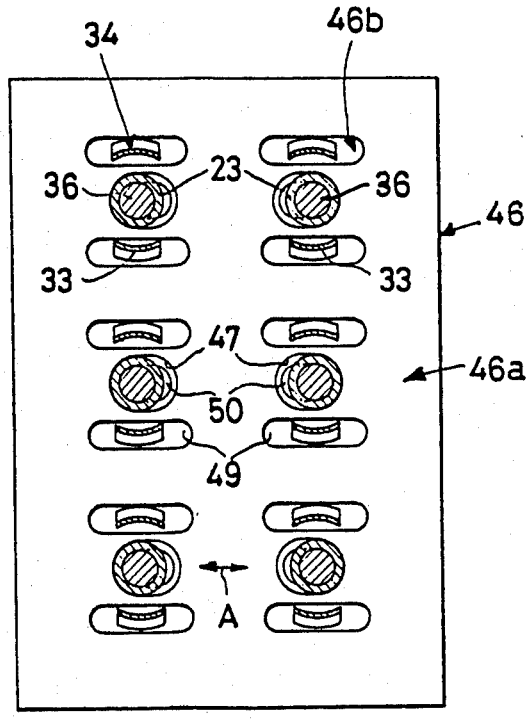
FIG. 11 is a plan view of the funnel member supporting plates in the apparatus of FIG. 5.

The funnel member supporting plate 56, therefore, is formed of two plates 56*a*, 56*b* placed one on top of the other and, as illustrated in FIGS. 10 and 11, the lower shaft portion 33 of the funnel member 32 passes through the oblong hole 57 formed in the direction of rows in the upper plate 56*a* and is extended further downwardly until its lower end comes into contact with the lower plate 56*b*. Further, the part of the lower shaft portion 33 which protrudes downwardly from the upper plate 56*a* is provided with a check ring 58 which serves to prevent the lower shaft portion 33 from being upwardly pulled out of the upper plate 56*a*. Consequently, the funnel members which are arranged side by side in the direction of files are allowed to be moved toward each other within the limits of the oblong hole 57.

Besides the aforementioned oblong hole 57, the two plates 56*a*, 56*b* of the second supporting plate 56 are provided each with one pair of oblong holes 59 for passing the leg 43 of the contracting member 44, and the lower plate 56*b* is provided with an oblong hole 60 for passing the shaft portion 46 of the axial member 45 which penetrates through the funnel member along the axis thereof.

For the supporting plate 56 to be stably slid on the supporting columns 53 during its travel between the first position (FIG. 10) and the second position at which the plate collides with the first supporting plate 54 (FIG. 14), it is supported by the sleeves 61 fitted around the supporting columns 53. Within the sleeves 61, spheres 63 energized by springs 62 in the direction perpendicular to the supporting columns are disposed to serve as stopper means 64. In the supporting columns 53, recesses 53*a*, 53*b* for receiving the spheres 63 to a depth about one half of their thickness are formed at positions corresponding to the aforementioned first and second positions, to enable the supporting plate 56 to be accurately supported at the first or second position.

The axial member 45 which penetrates through the center of the funnel member 32 is fixed to the third, lowermost supporting plate 65. The contracting member 44 is also fixed to the third supporting plate 65. Such a third supporting plate 65 is provided for each of the files of the carrier expanding and fitting means 31 used in the apparatus. As illustrated in FIG. 17, they are supported on a pair of horizontal stationary bars 66 through the medium of brackets 67 so as to be slidable thereon toward each other in the direction indicated by the arrow "A" (FIG. 9). In the first state illustrated in FIG. 9, the pair of supporting plates 65 are kept at mutually separated positions and they are also separated from the second supporting plate 56 positioned directly above. When the supporting plates 54, 56 and 65 are kept at the positions shown in FIG. 9, the relationship which exists among the components of the carrier expanding and fitting means 31 is such that the leading end 38 of the funnel member 32 passes through the sleeve member 49 and the outer periphery of the drum-shaped portion 47 of the axial member 45 remains in intimate contact with the stepped surface 48 of the funnel member 32 as illustrated clearly in FIG. 10.

Consequently, the funnel member 32 is prevented by the drum-shaped portion 47 from being bent inwardly toward the axis thereof, whereas the sleeve member 49 is kept in a state forcibly expanded radially so as to embrace therein the funnel member 32. At this time, the ring portion 42 of the contracting member 44 is kept at an elevated position at a distance from the first tapered portion 35 of the funnel member 32.

Figure 12:
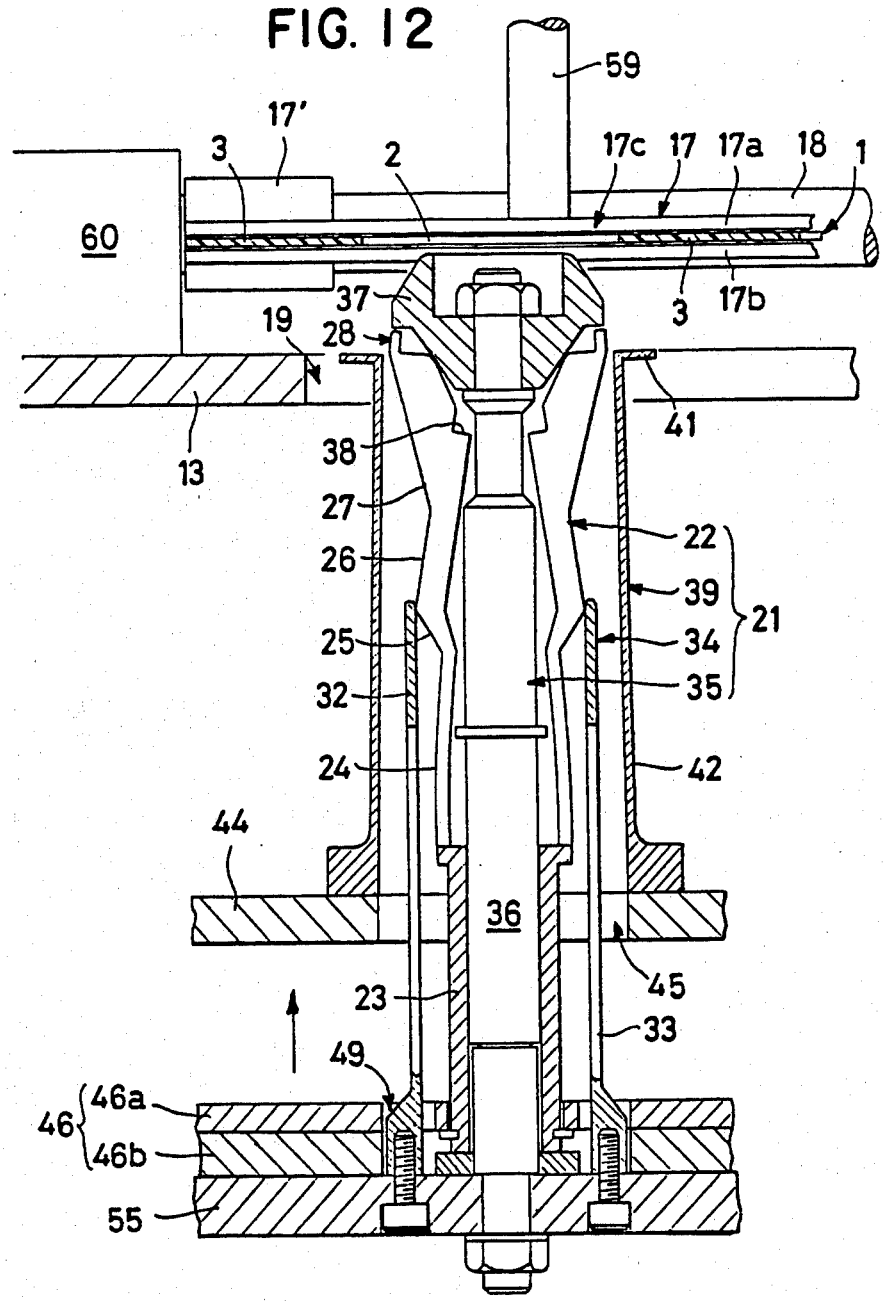
FIG. 12 is a sectioned view of the apparatus of FIG. 5 as taken along the line X—X of FIG. 9, showing the sheet carrier as disposed on the funnel member.

Now, the operation from this stage onward will be described below with reference to FIG. 12 and the following drawings. In these diagrams, the slits of the funnel member and other components which have no direct bearing upon the operation will be omitted.

Although, the apparatus of the present invention can be effectively operated with a carrier containing circular openings, many types of carriers in use today have elliptical openings as illustrated in FIG. 1. To ensure adaptability of the apparatus of this invention to such carriers, therefore, the axial members 45, the contracting members 44 and the funnel members 32 are opposed so as to be movable toward each other in the direction of files. The conventional carrier is such that the pitch $P_A$ at which the files of openings are separated after the carrier has been expanded in the direction of "Y" to facilitate the attachment of the carrier to containers is greater than the pitch $P_a$ at which the files of openings are formed at the time of the manufacture of the carrier. The aforementioned lateral deviation of the components is necessary to permit compensation for the difference between these two pitches. It should be noted in this connection that the pitch between the files of sleeve members 49 is equal to the pitch $P_A$ at which the files of openings are separated after the carrier has been attached to the containers. Consequently, the other three members 32, 44 and 45 illustrated in FIGS. 9 and 10 are separated by the pitch $P_A$ in their respective pairs.

For example, in attaching a carrier containing openings in two rows and three files to containers, the operator of the apparatus is required to take hold of the handle 69 (FIGS. 5–7) and move the carrier transfer means 27 which has nipped the sheet carrier 1 onto the open portion 29 of the working plane 23. In this case, stoppers 70 or some other similar means adapted to stop the transfer means 27 at the exact position at which the openings 2 in the carrier rest directly above the individual carrier expanding and fitting means 31 are provided in the terminal sections of the guide bars 28.

Microswitch 71 or some other similar position detecting means is not actuated until it is hit by the transfer means 27 at the precise moment that the carrier is brought to the prescribed position mentioned above. The microswitch 71, when actuated, sets the motor or other similar drive means (not illustrated) into motion. One end of the crank rod 73 is eccentrically connected through the medium of a pin **73*a* to a rotary shaft 72 (FIG. 17) which is interlocked to the drive means, with the result that the aforementioned one end of the crank rod 73 is rotated along the path "T" shown in FIG. 9 and, through the medium of the connecting rod 74 pivotally attached to the other end 73*b* of the crank rod, the two horizontal rods 66 fastened such as with set-screws to the connecting rod 74 in a direction perpendicular to the direction in which the connecting rod 74** is extended begin to produce an upward motion.

The horizontal rods 66, with the aid of the brackets 67, support the third supporting plates 65 in the respective files. The third supporting plates 65, therefore, begin to move upwardly as shown by the arrow $B_1$ in FIGS. 9 and 10. At this time, the force exerted in the rising direction is simultaneously applied to the respective second supporting plates 56 by means of the link arms 68 each having one end pivotally attached to the third supporting plate 65 and the other end pivotally attached to the second supporting plate 56. Since the second supporting plate is kept fast in the first position by the stopper means 64, it is retained at the first level of height without being pushed up.

Figure 13:
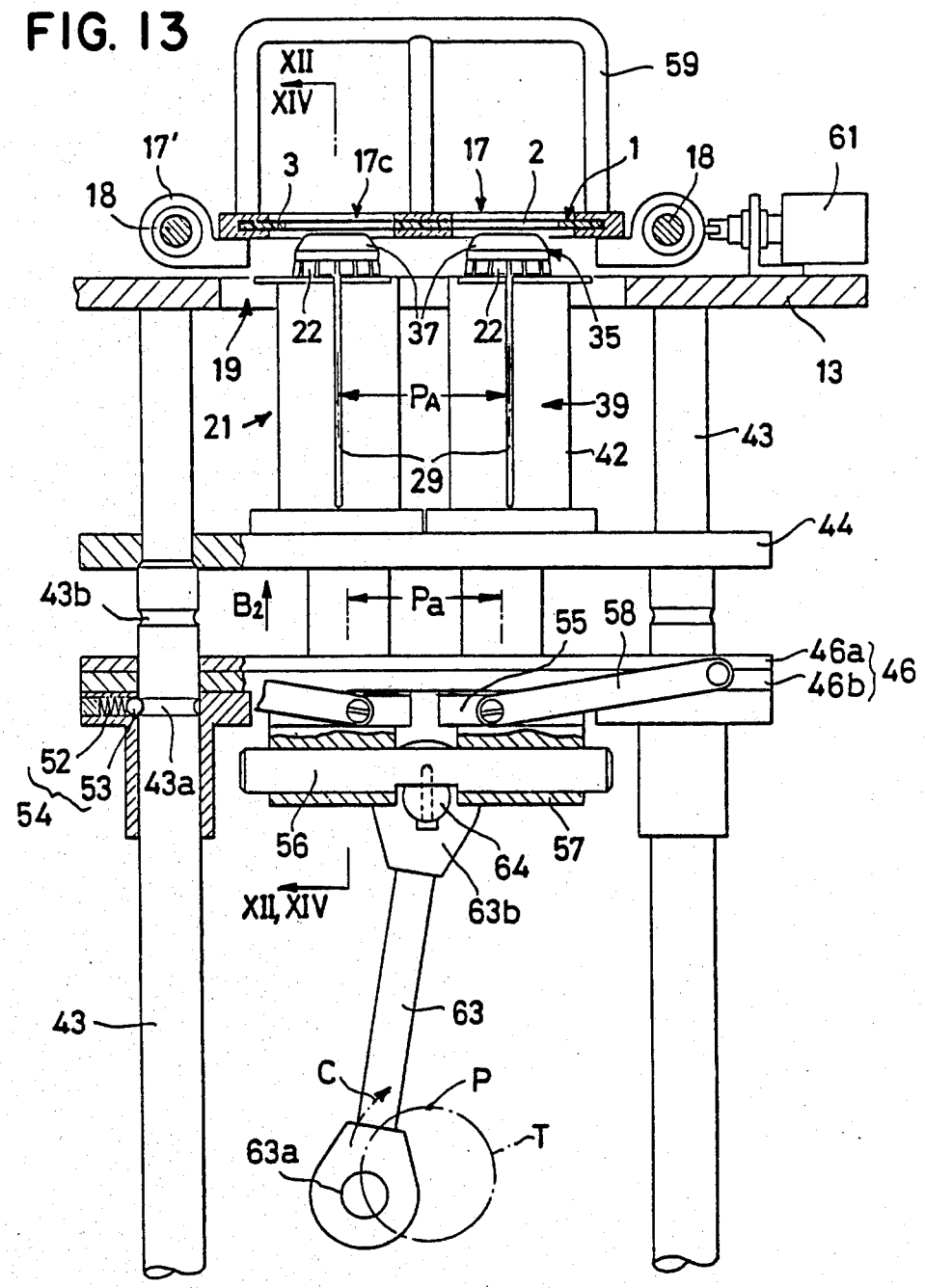
FIG. 13 is a front view of the apparatus of FIG. 5 as held in the condition of FIG. 12.

While the crank rod 73 is in the process of moving upwardly, the third supporting plates 65 eventually collide with the second supporting plate 56. The state during the upward motion of the crank rod 73 is illustrated in FIGS. 12 and 13. During this upward motion, the third supporting plates 65 are moved toward each other on the horizontal rods 66 owing to the rotary arcuate motion of the link arms 68 with the arms' pivotal points of attachment to the second supporting plate 56 as the fulcrums. As a result, the axial member 45, the contracting member 44 and the funnel member 32 through which the axial member passes are caused to move laterally within the respective oblong holes 57 and 59 and the pitch of these member in their respective pairs is reduced from pitch $P_A$ to pitch $P_a$ (FIG. 13).

In consequence of the aforementioned upward motion of the third supporting plates 65, the contracting member 44 and the axial member 45 are caused to move upwardly and the drum-shaped portion 47 at the leading end of the axial member is disengaged from the funnel member 32 and thrust upwardly. In the meantime, the ring portion 42 at the leading end of the contracting member 44 collides with the first tapered portion 35 of the funnel member 32 and exerts an upward pressure on the funnel member. Since the second supporting plate 56 remains at the first level of height by overcoming the upward pressure exerted upon the funnel member, the funnel member 32 from which the drum-shaped portion of the axial member has been pulled up comes to receive the upward pressure being exerted upon the first tapered portion as an inward bending force in the radial direction, with the result that the leading end 38 of the funnel member is contracted.

In consequence of the radial contraction of the leading end of the funnel member mentioned above, the sleeve member 49 which has been forcibly expanded is caused to resume its original diameter. Despite this change in the diameter, the pitch $P_A$ of the adjacent sleeve members 49 in the pair remains the same.

The drum-shaped portion 47 of the axial member is designed so as to have a diameter smaller than the diameter of the openings 2 in the carrier. When the funnel member is contracted, the leading end 38 thereof is positioned underneath the drum-shaped portion of the axial member and drawn to a diameter smaller than the diameter of the opening in the carrier. As the crank rod 73 continues its rotary motion further and exerts an upward pressure further to the third supporting plates 65, since the third supporting plates 65 have already collided with the second supporting plate 56, the upward pressure eventually builds up so much as to overcome the resistance offered by the stopper means 64.

Consequently, the third supporting plates begin to rise toward the first supporting plate 54 in conjunction with the second supporting plate 56. At this time, the axial member 45, the funnel member 32 and the contracting member 44 simultaneously move upwardly while keeping intact the relationship shown in FIG. 12. By the time the second supporting plate comes into contact with the first supporting plate 54, one half of the entire length of the second tapered portion 37 of the funnel member has risen past the opening 2 of the carrier held in position above as shown in FIG. 14.

The electric circuit for the driving means is constructed so that the crank rod 73 is brought to a temporary stop at a fixed position when the three supporting plates 54, 56 and 65 fall exactly one on top of another as illustrated in FIG. 14. At this time, the crank rod is at the upper dead point.

The mechanism used for bringing the movement of the mechanical parts to a temporary stop at the position indicated in FIG. 14 may be suitably selected from among the automatic mechanisms capable of producing such a stop heretofore known to the art.

For example, the mechanism may be of a construction such that when the pin 73*a* of the crank rod 73 reaches its prescribed position, the microswitch Sw is actuated to break the connection between the power source and the driving means (FIG. 17).

After the funnel members 32 have partly emerged from their respective openings 2 in the carrier, the operator is required to take hold of the handle 69 and return the carrier transfer means 27 back to its first position illustrated in FIG. 5. Since in the portion of the carrier in which the funnel members 32 have been inserted through the openings 2, the edges of the openings are caught fast by the second tapered portions 37 of the corresponding funnel members, the carrier is not allowed to return and the carrier transfer means 27 alone is allowed to slide on the carrier and return (in the direction indicated by the arrow "D"), nip the next portion of the carrier sheet containing openings in two rows and three files and await the subsequent transfer to the second position again.

The arrival of the carrier transfer means 27 at its first position is detected by the microswitch 75 which is actuated by being hit by the carrier transfer means (FIG. 5). Consequently, the driving means is connected to its power source (not shown) and the crank rod 73 is allowed to begin its downward rotation.

Since, at this time, the second supporting plate 56 is kept at the second level of height by the stopper means 64, the third supporting plates 65 alone are allowed to go down.

Figure 15:
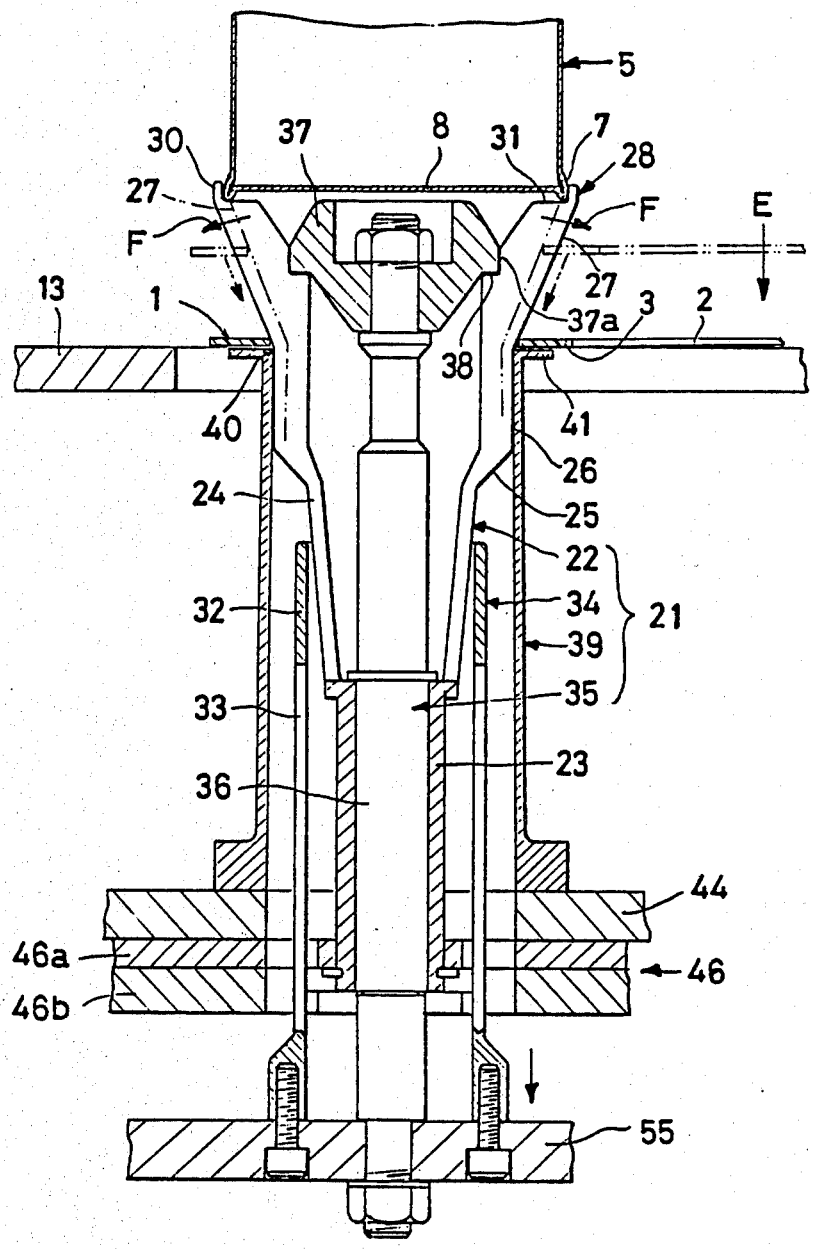
FIG. 15 is a sectioned view of the apparatus of FIG. 5 as taken along the line X—X of FIG. 9, showing the container as disposed in the open end of the funnel member after the opening of the sheet carrier has been fitted around the peripheral surface of the funnel member.

As the third supporting plates 65 are lowered, in each of the carrier expanding and fitting means 31 the ring portion 42 of the contracting member 44 which has so far kept the funnel member 32 in its contracted state gradually moves down the first tapered surface 35 of the funnel member 32 and, in consequence of this downward movement of the ring portion 42, the second tapered surface 37 of the funnel member 32 gradually opens out and eventually comes into, as though in a pressed condition, contact with the edge of the opening in the carrier (as indicated by the chain line and the arrow "E" in FIG. 15).

The contracting member 44 still continues to move down and the drum-shaped portion 47 of the axial member 45 which is simultaneously going down begins to enter again the opening at the leading end of the funnel member and, consequently, the leading end of the funnel member increases in diameter. When the part of the smallest diameter in the second tapered portion 37 of the funnel member eventually expands to a diameter equalling the diameter of the opening 2, the microswitch Sw disposed as described above is actuated to bring the driving means to a stop.

As the second tapered portion 37 of the funnel member gains in diameter, the carrier 1 having the annular portion surrounding the opening 2 fitted tightly on the outer surface of the second tapered portion slides down the tapered portion so as to avoid the possibility of deformation as much as possible and reaches a position directly above the flange 51 encircling the opening of the sleeve members 49 and, at the same time, the third supporting plates 65 which are now moving downward have their pitch returned by the action of the link arms 68 to their pitch $P_A$. Consequently, the annular portions 3 of the sheet carrier 1 are forcibly elongated in the direction of the files.

In the present embodiment, the portion of the sheet carrier which has been attached to the containers as described above is cut off the subsequent portion of the carrier containing openings in two rows and three files and nipped in the carrier transfer means 22 awaiting the transfer to the second position by utilizing the downward movement of the carrier 1 along the tapered portion.

Figure 18:
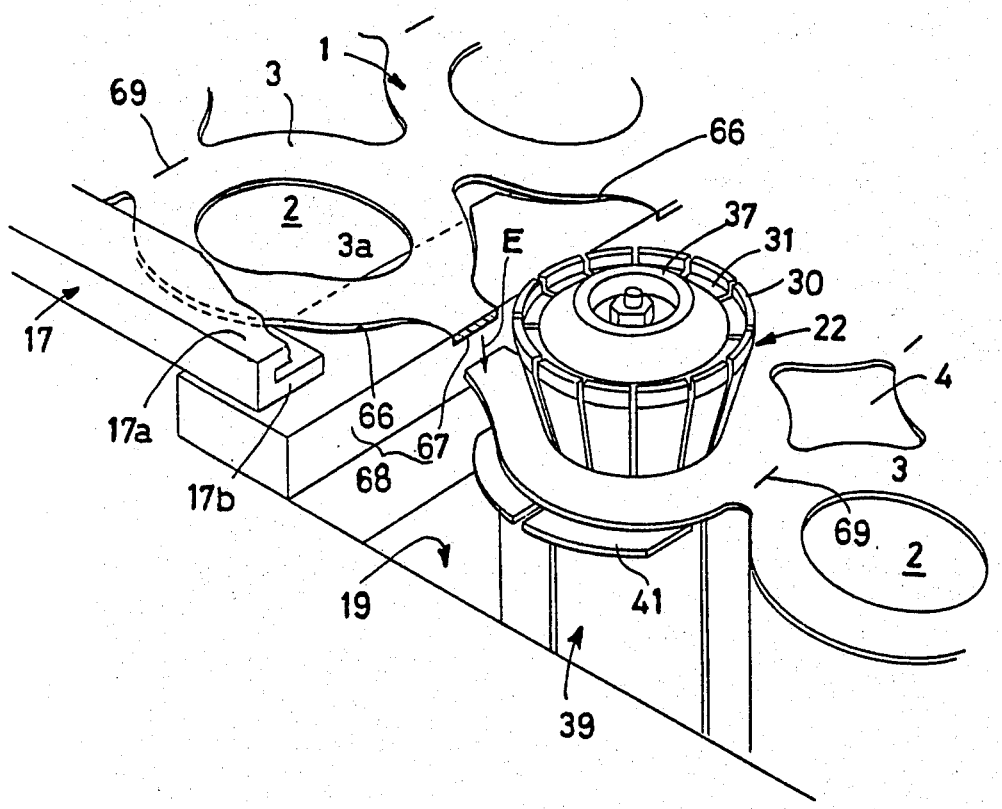
FIG. 18 is an enlarged perspective view of the essential part of the apparatus, showing the condition in which the sheet carrier is cut.

To be specific, underneath the leading end of the carrier nipped by the carrier transfer means 27 which is kept at its first position, the cutter means 78 formed of a depression 76 conforming to the shape of the leading end of the carrier and a cutting blade 77 is disposed as illustrated in FIG. 18. Since the height of this cutting blade 77 is substantially equal to the thickness of the carrier nipped in the carrier transfer means 27, the portion of the carrier into which the funnel members 32 nearest to the cutting blade have been fitted is torn from the subsequent portion of the carrier which is held back from motion by the depression 76 owing to the force applied to their borderline against the cutting blade when the preceding portion of the carrier is lowered as shown in FIG. 18. This tearing of the adjoining portions of the carrier may be facilitated by inserting perforations 79 along all the borderlines of the annular portions of the carrier in the whole carrier strip after the strip has been molded.

Figure 16:
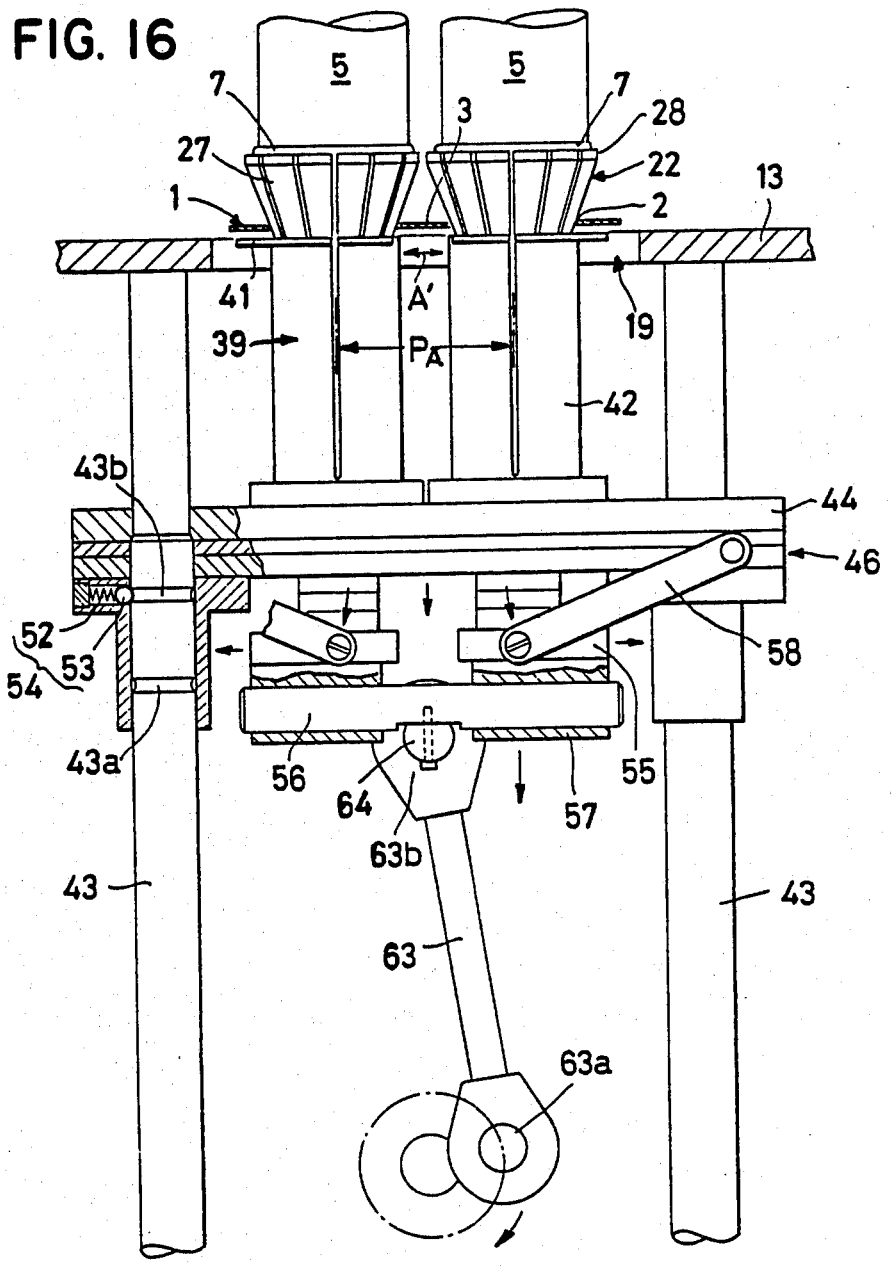
FIG. 16 is a front view of the apparatus of FIG. 5 as held in the condition of FIG. 15.

In the second stop position illustrated in FIGS. 15 and 16, the leading ends 38 of the funnel members 32 are radially expanded by the drum-shaped portions 47. At this point, the operator is required to cause the peripheral edges 7 of the containers 5 awaiting attachment of the carrier to be fitted into the spaces enclosed by the inner wall surfaces 40 and the stepped surfaces 41 of the leading ends 38 of the funnel members 32 by the following manual work. This work is accomplished by the operator inserting six containers one each into the six funnel members. FIGS. 15 and 16 show the containers as already set in position in the funnel members as described above. Then, the operator uses the microswitch Sw to connect the driving means to its power source and cause the crank rod 73 to resume its downward movement.

Consequently, the funnel member supporting plate 56 begins to go down overcoming the resistance of the stopper means 64 because the axial member 45 has been brought into engagement with the funnel member 32 and further because the link arms 68 have been stretched to their full length. In consequence of the downward movement of the second supporting plate 56, the opening 50 of the sleeve member 49 is expanded in the radial direction "G" by the tapered outer surface of the second tapered portion 37 of the funnel member 32 which is prevented from inward radial contraction because of the presence of the drum-shaped portion 47. At the same time, the opening 2 in the carrier 1 is forcibly expanded in the radial direction because of the gradual forced entry of the second tapered portion 37 into the opening 2.

Conversely, the force of restitution which the sleeve member 49 exerts on the funnel member 32 has its effect manifested in the direction of contracting the second tapered portion 37 of the funnel member as much as possible. This force is transmitted to the leading end of the funnel member and is transformed into a force with which the inner wall surface 40 takes firm hold of the outer face of the peripheral edge of the container 5, with the result that the container 5 is safely lowered in conjunction with the funnel member.

As the second and third supporting plates 56, 65 are lowered to the positions shown in FIG. 10, the crank rod 73 is brought to the position preset for its detection by microswitches or other similar devices and the driving means for the apparatus is brought to a stop, the carrier 1 which has been radially expanded to its fullest extent is, in effect, moved past the generally coinciding leading ends of the sleeve member and the funnel member and thrust relatively toward the containers. Consequently, the annular portions 3 tend to contract radially with their inner edges 3*a* of contact with the containers as fulcrums and come to be wrapped around the outer surfaces of the containers 5 below their peripheral edges.

With this operation, the attachment of the carrier to the containers is completed. At this point, therefore, the six containers bound in one set are ready for manual removal as illustrated in FIG. 2.

For the carrier, the sleeve members 49 fulfill the function of causing the edges of their openings 50 to push the carrier up the second tapered portions 37 of the funnel members in the direction of the containers 5. In this case, the flanges 51 extended radially from the edges of the aforesaid openings 50 of the sleeve members serve the purpose of preventing the carrier from being pulled in toward the funnel members. On completion of one cycle of the attachment work described above, the carrier transfer means 27 is moved and the newly supplied portion of the carrier is attached to the new set of containers by repeating the same procedure. When this operation is continuously repeated for a long time, there arises a possibility that the heat of friction generated in various components of the apparatus will have some adverse effects upon the sheet carrier made of a synthetic resin or soften the carrier to a point where the carrier tends to adhere to the outer surfaces of the funnel members. Where the apparatus is intended for such a heavy work load, the trouble may be precluded by having the funnel members made of aluminum or other material which permits ready radiation of heat.

The preceding embodiment has been described as using sheet carriers paid off successively from a roll and containing six openings in two rows and three files and attaching each carrier to a half dozen of containers. There is absolutely no need to limit this invention by the number of openings formed in each carrier. The carrier can contain any number of openings and, in an extreme case, may contain just one opening in one row and one file, for example. In the case of a carrier molded to have openings in the shape of a true circle, for example, no use is found for the lateral sliding motion imparted to the third supporting plates 65.

By the ordinary technique of mechanical automation, the component parts of the apparatus of this invention can be freely designed so as to produce movements in any prescribed sequence and timing. A motor, reduction gears, and the like may be mounted as sources for driving means on the supporting plate 80 at the lower ends of the supporting columns 53, for example. Around each component part which requires force of restitution, there may be disposed a rubber band or some other suitable means capable of aiding in generating such force.

These considerations are similarly useful in the embodiment of full automation of the apparatus of this invention to be described herein below.

Ths second embodiment illustrated in FIGS. 21–30 represents a modification of the apparatus capable of continuously attaching the carrier to a succession of containers supplied in files each of two containers.

The carrier expanding and fitting means 31 consists of the same components as those of the means in the first embodiment. Thus, like components will be denoted by like numerical symbols. The only exception is the spatial arrangement of these components, which is reversed in the vertical direction from that in the first embodiment. The basic operation of this means, therefore, can be comprehended by reading the procedure of the first embodiment with the vertical sequence thereof reversed.

In the present embodiment, while the containers supplied in a succession of files each of two containers are in the process of traveling on the working plane 23 from the one end 23*a* to the other end 23*b* thereof, the one set of two carrier expanding and fitting means 31 which are similar in construction to the carrier expanding and fitting means of the first embodiment except for the fact that they are suspended from above causes the containers to be fitted, file to file, into the openings formed in a similar pattern in the carrier.

For the driving force required to advance the succession of files of containers from the inlet end 23*a* of the working plane to the fitting position (corresponding to the open portion 29 of the working plane in the first embodiment) 81 opposed to the carrier expanding and fitting means 31, the present embodiment relies on the conveyor means 82 of known mechanism which serves to forward the containers to the inlet end 23*a* of the working plane.

The conveyor means 82 may be in any of the forms known to the art. For example, it may be of a type which, as indicated by the chain line, is provided with three frames 82′ extending along the opposite lateral edges and on the center line of the conveyor thereby enabling the containers 5 to be arranged in two rows spaced with a fixed interval.

Each time that the carrier has been attached to a file of two containers, the file of containers is forwarded by the pitch of the files by the operation of the container forwarding lever 83 and released from the outlet end 23*b* of the working plane so as to slide down the chutes 84 and land on the discharge conveyor 85.

Figure 21:
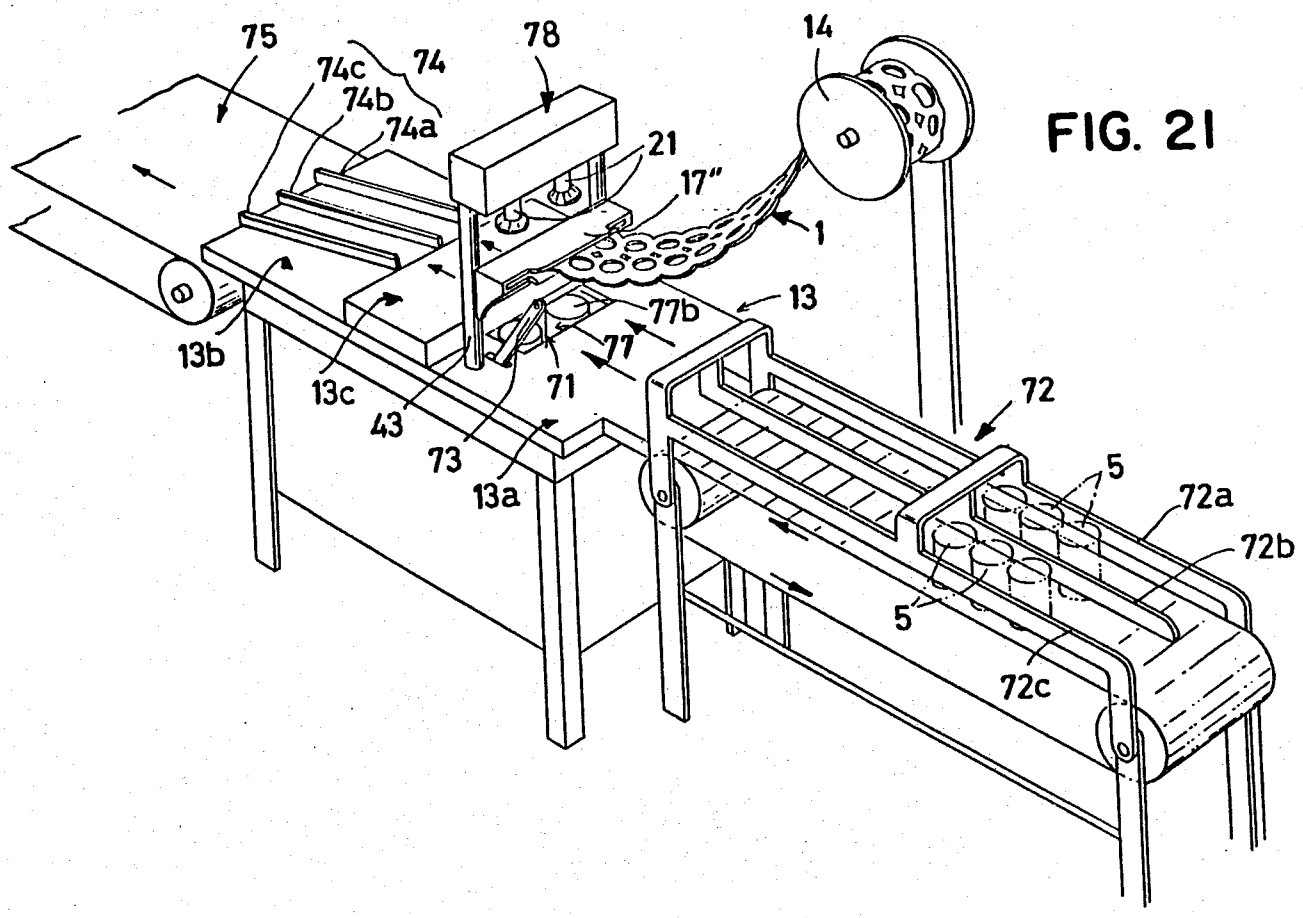
FIG. 21 is a schematic perspective view of the second embodiment of the apparatus for the attachment of sheet carriers to containers according to the present invention.
Figure 22:
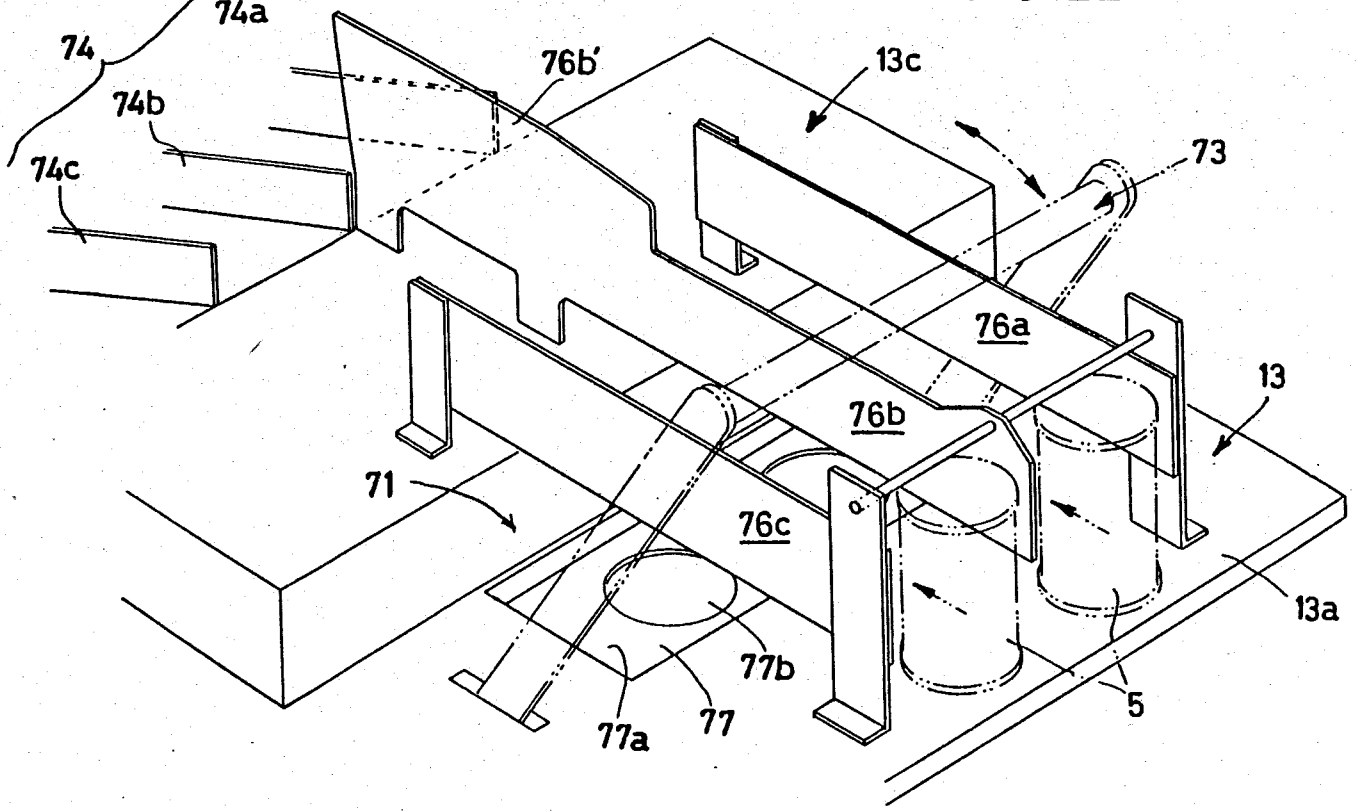
FIG. 22 is a schematic enlarged perspective view of the passage for containers in the apparatus of FIG. 21.
Figure 23:
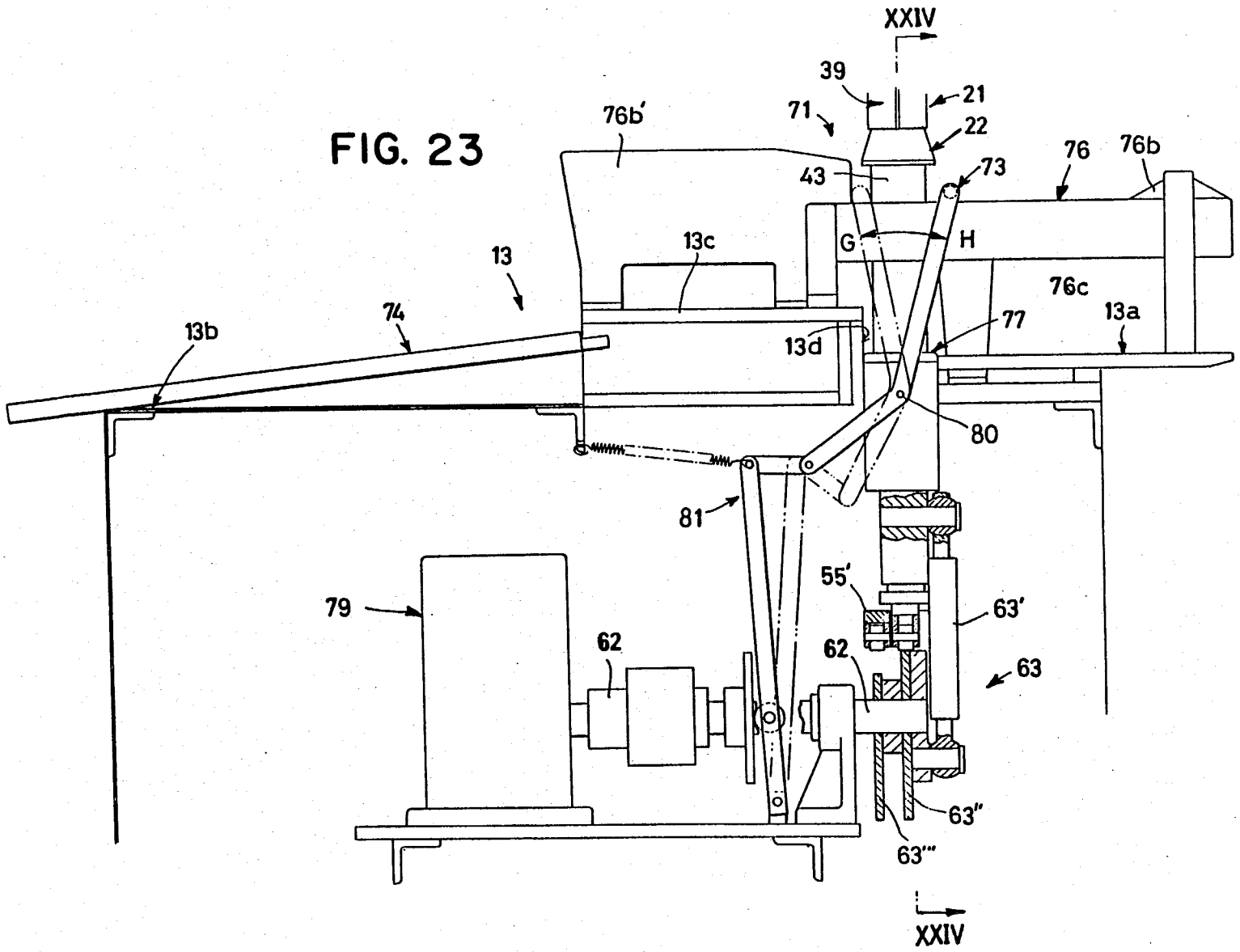
FIG. 23 is a sectioned side view of the apparatus of FIG. 21.

To keep the containers in neat arrangement on the working plane 23, a guide member 86 (not shown in FIG. 21) is disposed straight in the direction of the travel of containers as illustrated in FIG. 22. In the present embodiment, the guide member 86 is composed of three wallshaped frames which extend on the other sides and the center line of the two paths for permitting passage of containers from the inlet end 23*a* of the working plane serving to receive the incoming containers from the inlet conveyor 82 to the container lifting platform 87 below the carrier fitting position 81. Beyond the point at which the carrier is attached to the containers, since the containers in the one file have already been bound by the carrier, the central guide frame alone of the guide member 86 is extended over the path which extends from the portion 23*c* of the working plane raised above the remaining portion to the chute 84. In the chute 84, guide walls are raised. When necessary, similar guide means is provided for the discharge conveyor 85.

FIGS. 23–26 illustrate essential components of the automatic carrier fitting device described above. The carrier expanding and fitting member 31 comprises a sleeve member 49, a funnel member 32, a contracting member 44 and an axial member 45 similarly to the first embodiment, and these members are fixed similarly to their respective supporting plates 54, 56 and 65. These supporting plates are constructed so as to produce entirely the same relative movements. These supporting plates are housed within a box 88 which is held in position at the upper ends of the pair of supporting columns 53 extended upwardly from the working plane 23.

In the present embodiment, the driving means used for driving these supporting plates is disposed below the working plane. Thus, a group of connecting rods are disposed coaxially within the supporting columns 53 to permit control of the operation of the supporting plates 54, 56 and 65 from below the working plane. At the same time, the crank mechanism 73 is formed of one crank lever 73′ and two cam plates 73″ and 73‴. This arrangement is intended to perform the function to be described hereinafter. It can be freely designed and modified by any person of ordinary skill in the art.

The components of the present embodiment which are not included in the first embodiment are the container lifting platform 87 and the container forwarding lever 83. The container lifting platform 87 is made to produce a reciprocating motion in the vertical direction by the driving force delivered from the rotary shaft 72 of the known driving means 89 (FIG. 23) mentioned above via the crank lever 73′. The upward motion of the platform is timed for the moment at which the funnel member 32 is drawn into the sleeve member 49. The container forwarding lever 83 is caused, by a link mechanism 91 including a fulcrum 90, to produce a rotational reciprocating motion correspondingly to the vertical motion of the lifting platform 87.

Now, the functions of the individual components will be described.

Figure 24:
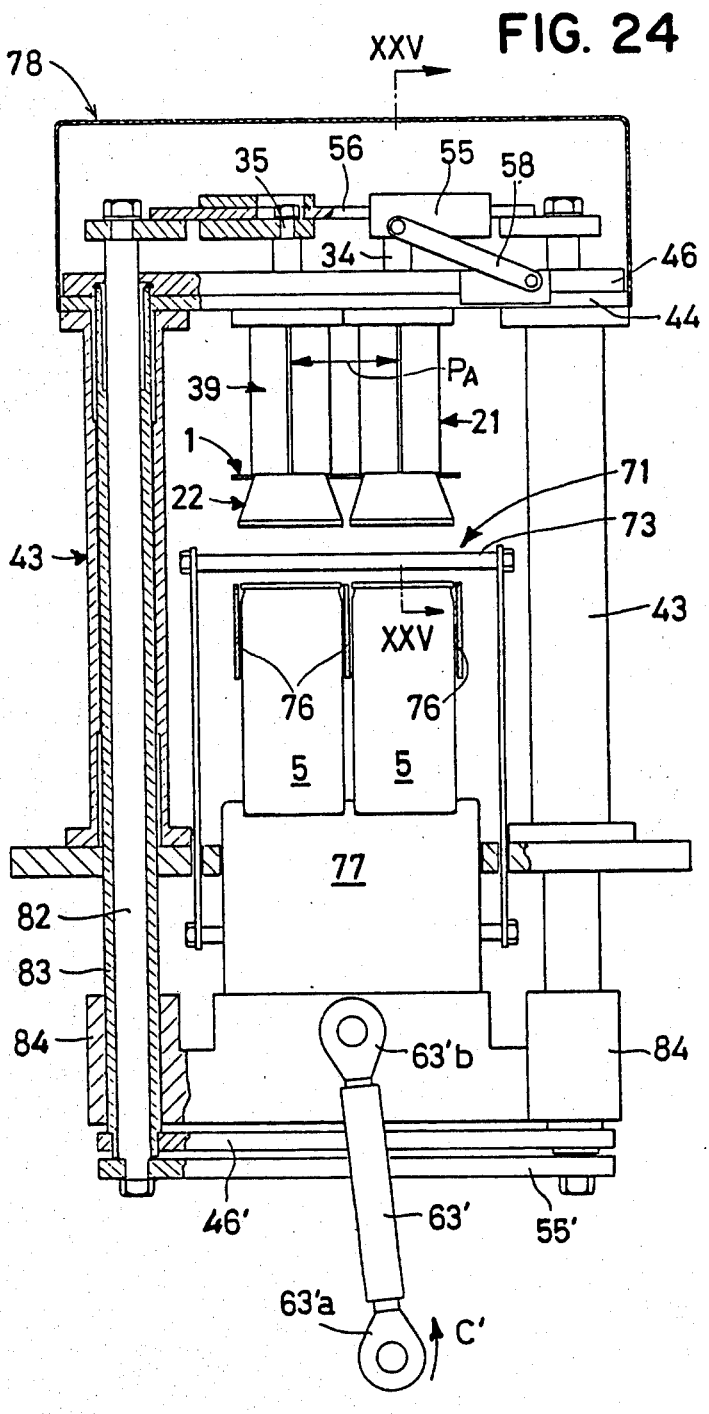
FIG. 24 is a sectioned view taken along the line XXIV—XXIV in FIG. 23.
Figure 25:
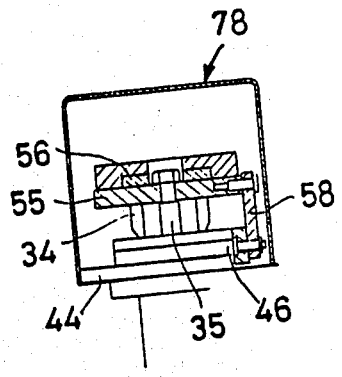
FIG. 25 is a sectioned view taken along the line XXV—XXV in FIG. 24.
Figure 26:
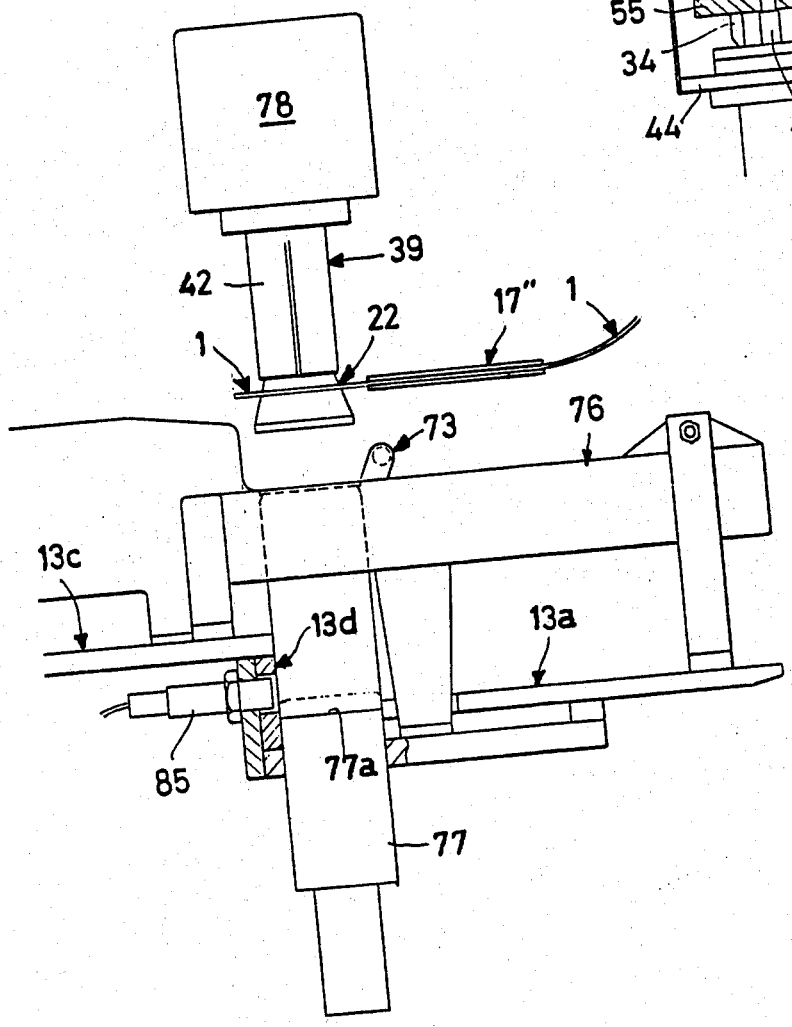
FIG. 26 is a side view of the essential part of the apparatus of FIG. 21, showing the sheet carrier as fitted around the funnel member.

First at the position at which the container lifting platform 87 reaches its lowest level, the upper surface 87*a* of the platform is flush with or slightly lower than the plane 23*a* on which the containers are brought in (FIG. 26) and the crank 73′ assumes a position lower than its position illustrated in FIG. 24.

At this time, the carrier expanding and fitting means 31 is in the same condition as shown in FIG. 14, with the funnel member 32 inserted as radially contracted within the opening 2 of the carrier 1. In this condition, therefore, the supporting plates 54, 56 and 65 are kept in intimate contact with one another. With a view, therefore, to positioning at the lowest level the uppermost supporting plate 65 to which the contracting member 44 and the axial member 45 are fixed, the two ends of the horizontal stationary bar 66 (FIG. 25) are connected to the lowermost supporting plate 65′ below the working plane through the medium of a connecting rod 92 passing through the center of the supporting column 53 and this supporting plate 65′ is positioned at the lowest level through cooperation thereof with the cam 73″.

Similarly, the funnel member supporting plate 56 is connected to the intermediary supporting plate 56′ through the medium of a second columnar connecting rod 93 disposed so as to encircle the connecting rod 92 within the supporting column 53 and is likewise positioned at the lowermost level through cooperation thereof with the second cam 73″.

The container lifting platform 87, for the purpose of producing a straight vertical reciprocating motion stably, secures guidance of the sleeve 94 slidably mounted round the outer surface of the second connecting rod 93.

In the condition described above, the pitch in the direction of files is compensated for by the link arm 68 in the same manner as in the first embodiment. In the condition illustrated in FIG. 27, the containers 5 to which the carrier has already been attached stand on the portion 23*c* of the working plane raised above the remaining portion. Since the carrier stock hangs down from the carrier guide 27′ only during the initial operation of the apparatus, the operator is required to fit the openings 2 in the first file manually round the protruding funnel members 32.

In the present embodiment, a carrier guide 27″ is fixed to the supporting columns 53 as illustrated in FIG. 21 and is adapted to keep the carrier 1 nipped between a pair of plates with tightness enough to exert mild resistance to the carrier. This carrier is continuously supplied in the direction of its travel from the supporting frame 25 supported in position at a suitable height close to the apparatus.

As a succession of files of containers 5 are pushed forward by the forwarding force of the delivery conveyor 82 and the first file of containers 5 are mounted on the surface 87*a* of the lifting platform, the arrival of the file of containers is detected as by microswitches 95 imbedded in the stepped wall surface 23*d* intervening between the surface 87*a* and the plane 23*c* for mounting the containers already bound with the carrier and, consequently, the driving system is actuated, with the result that, in the present embodiment, the crank mechanism 73 begins to rotate in the counter-clockwise direction C′ and push up the container lifting platform 87. In much the same way as the condition illustrated in FIG. 14 shifts to the condition illustrated in FIGS. 15–16 in the first embodiment, the third supporting plate 65 moves upwardly through the medium of the cam 73″ below the working plane, the corresponding supporting plate 65′ and the connecting rod 92 eventually to assume the condition illustrated in FIG. 24. Consequently, the carrier 1 is retained close to the open edge of the sleeve member 49 and the funnel member 32 is radially expanded.

Figure 19:
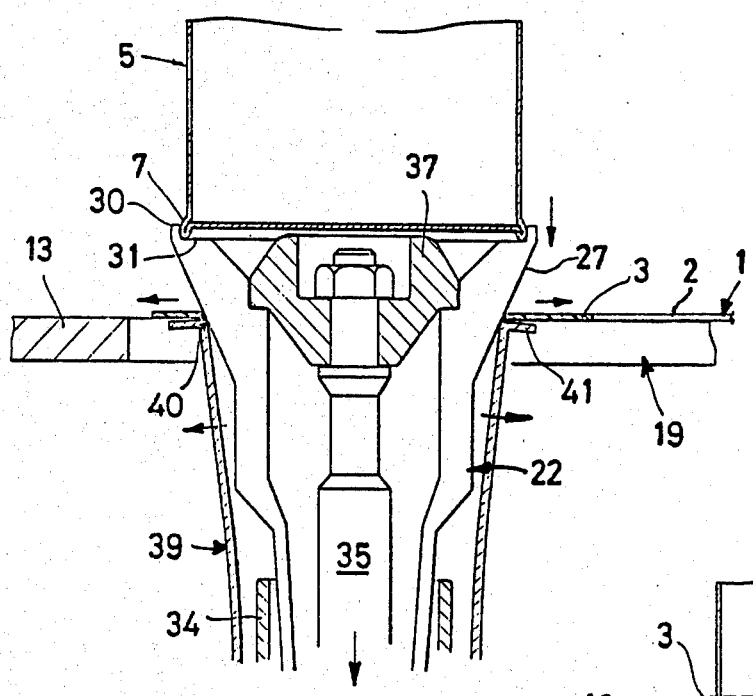
FIG. 19 is a sectioned view of the essential part of the apparatus of this invention, showing the condition in which the opening of the sheet carrier is radially expanded with the gradual increase in the outside diameter of the funnel member.
Figure 20:
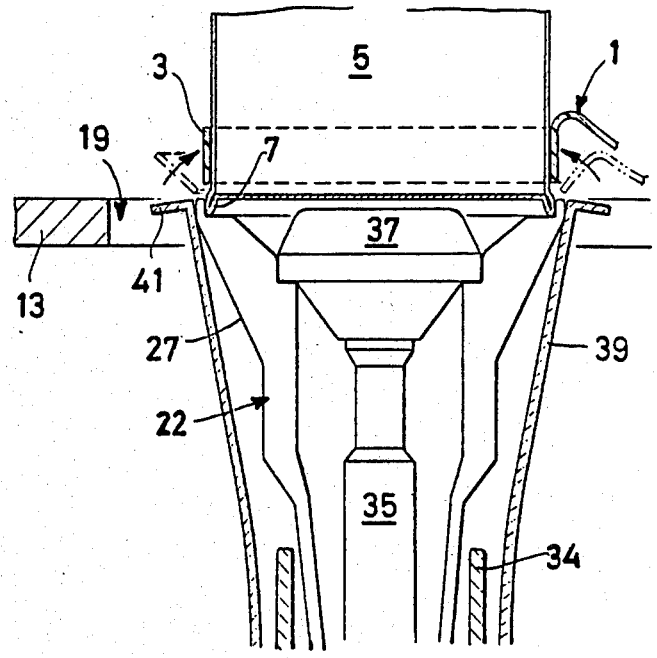
FIG. 20 is a sectioned view of the essential part of the apparatus of this invention, showing the sheet carrier as fitted around the peripheral surface of the container.

As the upward travel of the container lifting platform 87 is further continued, the peripheral edges 7 of containers are caught by the leading edges 38 of the funnel members in the same way as illustrated in FIG. 19. With a further rise of the lifting platform 87, the third supporting plate 65 and the second supporting plate 56 as kept at the distance shown in FIGS. 23–26 are gradually separated from the sleeve supporting plate 54 in the same manner as shown in FIG. 20 and the open edges of the sleeves 49 radially expand the openings 2 of the carrier 1 relatively in conformity to the outer wall surfaces of the second tapered portions 37 of the funnel members and complete the attachment of the carrier below the peripheral edges of containers. In the condition assumed consequently, the surface of the lifting platform is higher than the plane 23*c*. The movements which the third and second supporting plates 65, 56 produce during the preceding process are effected, similarly to the previous embodiment, through the medium of the corresponding cams 73″, 72‴ below the working plane, the supporting plates 65′, 56′ and the connecting rods 92, 93.

When the attachment of the carrier is completed, the crank rod 73′ causes the container lifting platform 87 still holding thereon the containers 5 bound with the carrier to go down (in the direction of the arrow F).

In response to this fall of the platform, the container forwarding lever 83, through the medium of the link mechanism 91 actuated by a known cam mechanism disposed perpendicularly to the rotary shaft 72, is moved in the direction of the containers indicated by the arrow G. As the lever collides with the containers and the surface 87*a* of the lifting platform 87 is lowered so much as to fall substantially flush with the plane 23*c* of the working plane 23 raised above the remaining portion, the containers are pushed in the direction of G′ onto the plane 23*c* of the working plane. In consequence of this movement of the forwarding lever, the forward motion of the containers bound with the carrier gives a pull to the carrier 1 and causes the subsequent file of openings 2 to be brought directly under the funnel member 32. In other words, in the present embodiment, the containers themselves constitute part of the carrier transfer means through the agency of the movement of the container forwarding lever 83.

Figure 27:
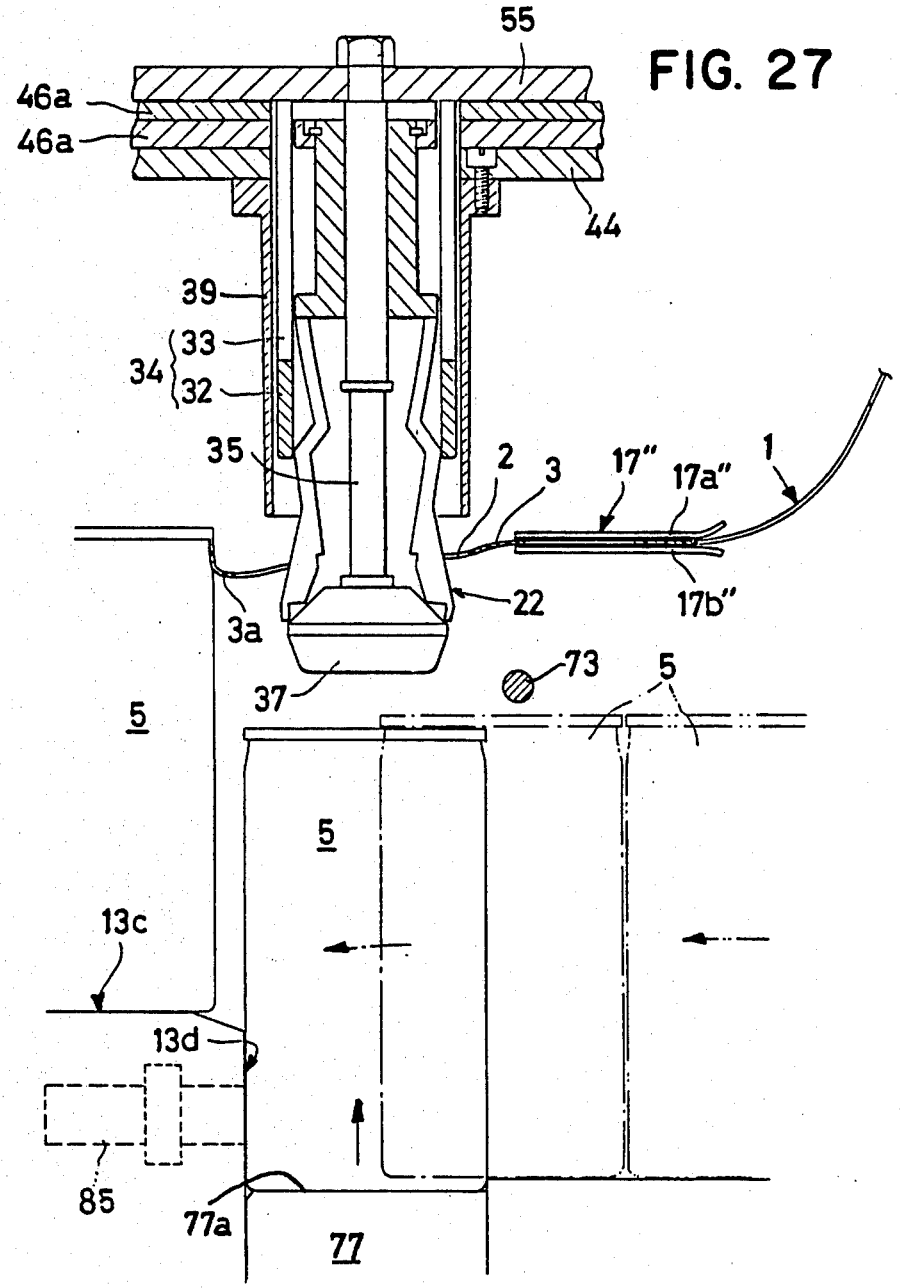
FIG. 27 is an enlarged sectioned view of the essential part of the apparatus as held in the condition of FIG. 26.
Figure 28:
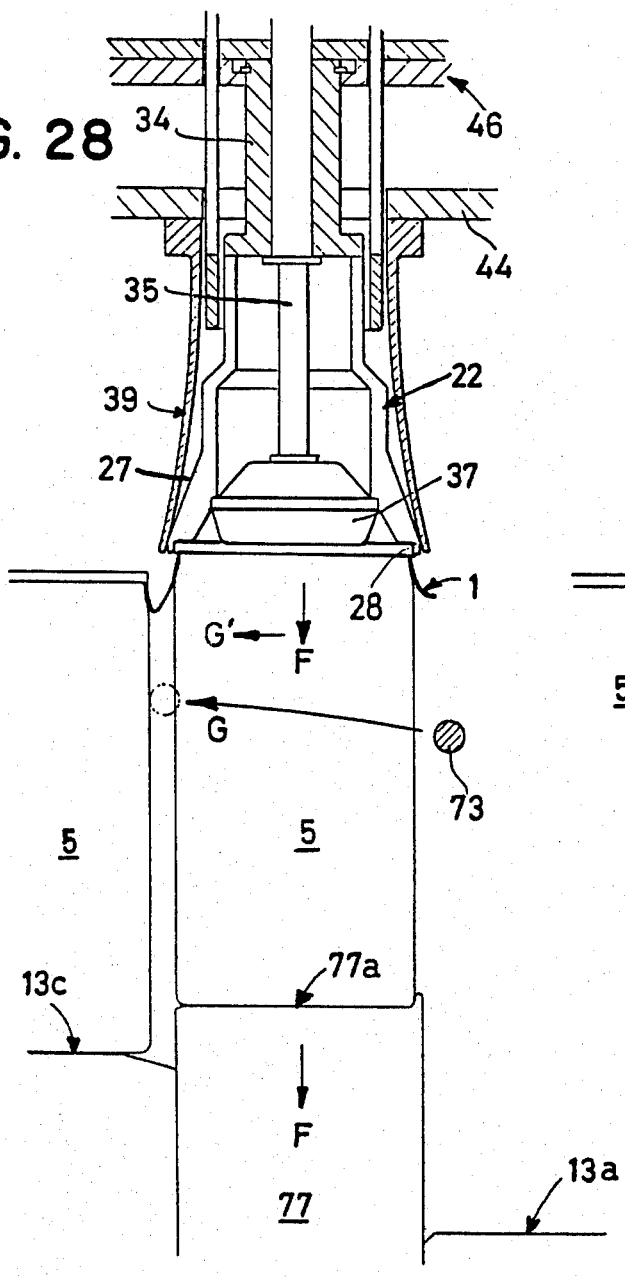
FIG. 28 is an enlarged sectioned view of the essential part of the apparatus of FIG. 21, showing the condition in which the sheet carrier fitted around the funnel member is attached to the container.
Figure 30:
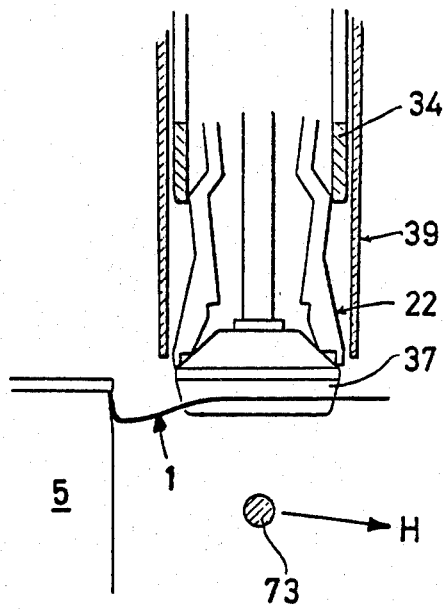
FIG. 30 is an enlarged sectioned view of the essential part of the apparatus of FIG. 21, showing the condition in which the leading end of the axial member is inserted into the opening of the sheet carrier disposed in the open end of the funnel member.
Figure 29:
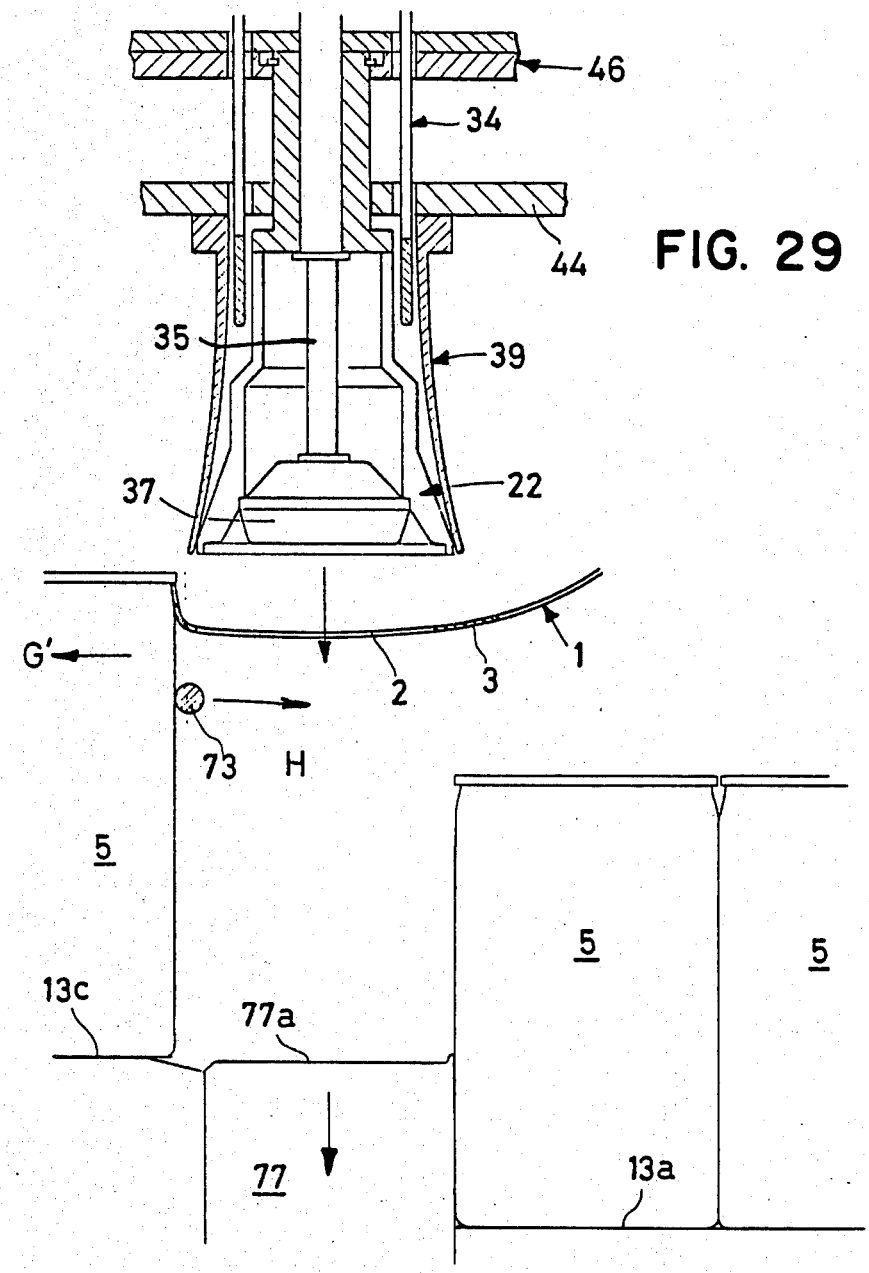
FIG. 29 is an enlarged sectioned view of the essential part of the apparatus of FIG. 21, showing the condition in which the container having the sheet carrier attached thereto is removed from the open end of the funnel member.

As the container lifting platform 87 is subsequently lowered, the container forwarding lever 83 also begins to return in the direction of the arrow "H" to resume its original position and, at the same time, the condition of the apparatus is returned through the condition illustrated in FIG. 30 to the condition of FIG. 27. Consequently, the foremost of the files of containers on the incoming side which has been stopped by the lateral wall surface of the lifting platform kept in a raised position are loaded on the platform to undergo the same cycle of handling. This operation of carrier attachment is repeated on every one of the succeeding files of containers. The present embodiment finds no use for the stopper 64 adapted to time the operation because the interactions among the individual components of the apparatus continuously depend on the respective cams and cranks. A detection switch 95 capable of detecting exhaustion of the supply of containers and bringing the operation of the apparatus to a stop can be provided but is not particularly needed as a rule. The components of the apparatus may be left operating continuously at the timing described above. It ought to be self-evident that the surface 87*a* of the lifting platform for supporting containers may be provided with depressions 87*b* (FIGS. 21–22) for admitting the bottoms of the containers and thereby enabling the containers to stand erect safely on their bottoms or the surface may be annexed with a cutter adapted to cut the carrier already attached to containers into sections each containing a fixed number of files of containers.

Of course, the number of carrier expanding and fitting means 31 arranged in a line can be increased freely when the pitch of the carrier requires no compensation.

As described above, the apparatus of this invention contributes immensely to the convenience of the work of carrier attachment to containers. Since the first embodiment of semi-automatic apparatus is not affected at all by the height of containers to be handled, it proves highly convenient such as for retail stores which frequently find it necessary to sell containers of various beverages in one set, whereas the second embodiment of fully automated apparatus proves particularly advantageous for factories, wholesalers, etc. which are required to handle containers in large quantities. When a slide-adjustment construction known to the art is incorporated as between the container lifting platform and the drive crank, for example, the second embodiment can be rendered usable for attaching the carrier to containers of varying heights.

Further in the second embodiment, the apparatus can be adapted so that the portion of the sheet carrier remaining intact between the opposed rows of openings already fitted around containers slides on the upper edge of the central guide frame (FIG. 22) and the carrier stock can be prepared so as to incorporate therein slits or perforations 79 of stated length and depth (FIG. 18). Consequently, packages each of, say, six containers arranged in two rows can be automatically and conveniently produced because each time a total of six containers are moved past the leading edge 86′ of the central guide frame and consequently hung down from the edge, the combined weight of the six containers gives a pull to the carrier sheet great enough to tear the portion of the sheet attached to these six containers along the perforation 69.

What is claimed is:

1. An apparatus for the attachment of a plastic sheet carrier having a plurality of openings each surrounded by an annular portion to a plurality of containers having peripheral edges of a diameter larger than the diameter of said openings by forcibly expanding said annular portions of said openings and causing said peripheral edges of said containers to come into tight engagement with said annular portions, which apparatus comprises:

(a) funnel members each having a first tapered portion and a second tapered portion arranged from the basal end to the leading end thereof and each having a plurality of slits longitudinally inserted from the leading end at least to said first tapered portion on the circumferential surface thereof so as to be radially contractable, the largest diameter of said first tapered portion being smaller than the diameter of said openings, the leading ends of said funnel members being engageable with the peripheral edges of said containers, (b) sleeve members associated one each with said funnel members and each having an opening for accommodating the associated funnel member therein and having a plurality of slits longitudinally inserted from the edge of said opening on the circumferential surface thereof, the diameter of said opening in its normal state being made smaller than the largest diameter of said second tapered portion, (c) contracting members associated one each with said funnel members and each being disposed concentrically between the associated funnel member and its sleeve member, being movable relative to said two members and being advanceable to cause the leading end thereof to be engaged with said first tapered portion of said funnel member to thereby contract said funnel member so as to cause the leading end of said funnel member to pass through said opening of said sheet carrier, (d) axial members associated one each with said funnel members and each disposed inside the associated funnel member and provided on the leading end thereof with a swollen portion which protrudes from the leading end of said funnel member as said contracting member advances toward the leading end of said funnel member and is retracted within the leading end of said funnel member as said contracting member moves toward the basal end of said funnel member to thereby prevent the leading end of said funnel member from being bent inwardly, (e) driving means causing said contracting members and said axial members to advance relative to said funnel members and said sleeve members to thereby contract the leading ends of said funnel members and insert the leading ends of said funnel members into said openings of said sheet carrier, then causing said contracting members and said axial members to retract relative to said funnel members and said sleeve members to thereby bring the contracted leading ends of said funnel members into their original states so as to expand said openings of said sheet carrier at the leading ends of said sleeve members and subsequently causing said funnel members, said contracting members and said axial members to retract relative to said sleeve members, (f) means for disposing the peripheral edges of said containers to face the openings of said sheet carrier when the openings of said sheet carrier are expanded at the leading ends of said sleeve members, and (g) means for transmitting a fresh plastic sheet carrier to a position corresponding to the leading ends of said funnel members after said containers to which said sheet carrier is attached are removed from said funnel members.

2. The apparatus according to claim 1, wherein said means for transmitting a sheet carrier comprises a pair of plates forming therebetween an interval which is the same as the thickness of said sheet carrier and means for causing said pair of plates to reciprocate from above the leading ends of said funnel members to a position at which a fresh sheet carrier to be attached to a plurality of containers is disposed, and transmits said sheet carrier to above the leading ends of said funnel members with said sheet carrier clamped therebetween.

3. The apparatus according to claim 1, wherein said means for transmitting a sheet carrier further comprises means for removing said containers to which said sheet carrier is attached from said funnel members.

4. The apparatus according to claim 1, wherein said funnel member, sleeve members, contracting members and axial members are retained all in a suspended state and said means for disposing said plurality of containers to face the openings of said sheet carrier comprises a lifting platform which is pushed up with said containers supported thereon to thereby dispose said containers to face the openings of said sheet carrier.

* * * * *